US011731427B2

(12) United States Patent
Morizono et al.

(10) Patent No.: US 11,731,427 B2
(45) Date of Patent: Aug. 22, 2023

(54) INK JET PRINTER AND NON-TRANSITORY RECORDING MEDIUM STORING COMPUTER PROGRAM FOR CLEANING

(71) Applicant: Roland DG Corporation, Hamamatsu (JP)

(72) Inventors: Kazuya Morizono, Hamamatsu (JP); Teppei Sawada, Hamamatsu (JP); Akifumi Arai, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 16/829,058

(22) Filed: Mar. 25, 2020

(65) Prior Publication Data

US 2020/0307220 A1 Oct. 1, 2020

(30) Foreign Application Priority Data

Mar. 26, 2019 (JP) ..... 2019-058324
Jun. 20, 2019 (JP) ..... 2019-114545

(51) Int. Cl.
*B41J 2/165* (2006.01)

(52) U.S. Cl.
CPC ..... *B41J 2/16508* (2013.01)

(58) Field of Classification Search
None
See application file for complete search history.

(56) References Cited

U.S. PATENT DOCUMENTS

2003/0107613 A1 6/2003 Nishioka
2004/0252157 A1* 12/2004 Yamazaki ..... B41J 2/16508 347/31
2008/0143778 A1* 6/2008 Sugiyama ..... B41J 2/16508 347/23
2011/0187790 A1* 8/2011 Yoshida ..... B41J 2/165 347/30
2014/0118448 A1* 5/2014 Domae ..... B41J 2/18 347/89
2017/0087846 A1* 3/2017 Ogawa ..... B41J 2/16508
2017/0136771 A1* 5/2017 Ogawa ..... B41J 2/16508
2019/0039378 A1 2/2019 Okuno et al.

FOREIGN PATENT DOCUMENTS

JP 2003-154686 A 5/2003
JP 2005-001322 A 1/2005
JP 2011-156753 A 8/2011
(Continued)

*Primary Examiner* — Erica S Lin
*Assistant Examiner* — Tracey M McMillion
(74) *Attorney, Agent, or Firm* — Keating & Bennett, LLP

(57) ABSTRACT

A printer includes an ink head including a nozzle surface including nozzles, a cap including an end portion contactable with the nozzle surface, a suction device, a memory, and a controller. The memory stores a suction position, a free suction position, and a minute open position located between the suction position and the free suction position. The controller performs a suction process in which the cap is located at the suction position and ink is sucked from the nozzles, and a minute open position process in which the cap is moved toward a minute open position and movement of the cap is stopped with the cap located at a minute open position, after the suction process.

8 Claims, 15 Drawing Sheets

(56) References Cited

FOREIGN PATENT DOCUMENTS

| | | | | | |
|---|---|---|---|---|---|
| JP | 2016-087858 | A | | 5/2016 | |
| JP | 2017-065179 | A | | 4/2017 | |
| JP | 2018-079573 | A | | 5/2018 | |
| JP | 2018089905 | A | * | 6/2018 | ..... B41J 2/175 |
| JP | 2019-025910 | A | | 2/2019 | |

* cited by examiner

FIG. 16

| | PROCESS | CAP POSITION | CONTACT WITH NOZZLE SURFACE | | PRESSURE IN CAP | DRIVING OF SUCTION PUMP | MOVEMENT AMOUNT OF CAP PER UNIT TIME |
|---|---|---|---|---|---|---|---|
| | | | CAP END PORTION | ABSORBER | | | |
| S201 | SUCTION PROCESS | SUCTION POSITION (P51) | CONTACT | NON-CONTACT | NEGATIVE PRESSURE | DRIVING | |
| S202 | FIRST MOVEMENT PROCESS | | CONTACT | NON-CONTACT | NEGATIVE PRESSURE | STOP | FIRST MOVEMENT AMOUNT (M1) |
| S203 | MINUTE OPEN POSITION PROCESS | MINUTE OPEN POSITION (P53) | PARTIALLY NON-CONTACT | NON-CONTACT | NEGATIVE PRESSURE | DRIVING | |
| S204 | SECOND MOVEMENT PROCESS | | NON-CONTACT | NON-CONTACT | ATMOSPHERIC PRESSURE | STOP | SECOND MOVEMENT AMOUNT (>FIRST MOVEMENT AMOUNT) (M2) |
| S205 | FREE SUCTION PROCESS | FREE SUCTION POSITION (P52) | NON-CONTACT | NON-CONTACT | NEGATIVE PRESSURE | DRIVING | |

INK JET PRINTER AND NON-TRANSITORY RECORDING MEDIUM STORING COMPUTER PROGRAM FOR CLEANING

CROSS REFERENCE TO RELATED APPLICATIONS

This application claims the benefit of priority to Japanese Patent Application No. 2019-058324 filed on Mar. 26, 2019 and Japanese Patent Application No. 2019-114545 filed on Jun. 20, 2019. The entire contents of these applications are hereby incorporated herein by reference.

BACKGROUND OF THE INVENTION

1. Field of the Invention

The present teaching relates to an ink jet printer and a non-transitory recording medium storing a computer program for cleaning.

2. Description of the Related Art

JP2016-87858A discloses an ink jet printer including an ink head having nozzles from which ink is discharged. The ink jet printer disclosed in JP2016-87858A includes a cap unit in order to maintain discharge performance of the nozzles. The cap unit includes a cap attached to a nozzle surface where the nozzles of the ink head are in a printing standby mode, and a suction pump connected to the cap.

Attachment of the cap to the nozzle surface forms a closed space between the nozzle surface and the cap. When the suction pump is driven with the closed space formed, ink remaining in the ink head can be thereby ejected to the cap. This suction process for ejecting ink in the ink head will be referred to as a suction process.

After the suction process, in order to eject ink remaining in the cap, the suction pump is driven in a state where the nozzle surface is separated from the cap to make the closed space open to the atmosphere. With this driving, ink in the cap can be ejected without an excessive negative pressure on the ink head. This suction process for ejecting ink in the cap will be referred to as a free suction process.

In the ink jet printer described above, a negative pressure adjustment process is performed in some cases after the suction process. The negative pressure adjustment process refers to a process in which the suction pump is stopped for a predetermined time with the cap attached to the nozzle surface. Dirt attached to the nozzle surface or the like can be mixed in ink in the cap. Thus, the negative pressure adjustment process is performed for a longer time, ink including dirt or the like is more likely to flow back into the nozzles. Before the free suction process is performed, the cap is detached from the nozzle surface so as to separate the cap from the nozzle surface. In this detaching of the cap, a pressure difference occurs between the inside of the cap and the outside of the cap to cause ink in the cap to spatter in some cases.

SUMMARY OF THE INVENTION

Preferred embodiments of the present invention provide ink jet printers in each of which ink in a cap does not easily enter nozzles of an ink head and ink in the cap does not easily spatter, and also provide non-transitory recording media that each store a computer program to perform cleaning.

An ink jet printer according to a preferred embodiment of the present disclosure includes an ink head, a cap assembly, a memory, and a controller. The ink head includes a nozzle surface including first nozzles that discharge ink. The cap assembly includes a cap, a suction device, and a capping mechanism. The cap is attachable to the nozzle surface to cover the first nozzles and includes an end portion that is contactable with the nozzle surface when attached to the nozzle surface. The suction device is connected to the cap. The capping mechanism is attachable the cap to the nozzle surface and separate the cap from the nozzle surface. The memory stores a suction position, a free suction position, and a minute open position beforehand. The suction position is a position of the cap at which the end portion of the cap is in contact with the nozzle surface and ink in the first nozzles is sucked by the suction device. The free suction position is a position of the cap at which the end portion of the cap is separated from the nozzle surface and ink in the first nozzles is not sucked by the suction device. The minute open position is located between the suction position and the free suction position. The controller performs a suction process, a movement process, and a minute open position process. In the suction process, ink is sucked from the first nozzles with the cap located at the suction position. In the movement process, the cap is moved toward the minute open position after the suction process. In the minute open position process, movement of the cap is stopped with the cap located at the minute open position after the movement process.

Another ink jet printer according to a preferred embodiment of the present disclosure includes an ink head, a cap assembly, a memory, and a controller. The ink head includes a nozzle surface including first nozzles that discharge ink. The cap assembly includes a cap, a suction device, and a capping mechanism. The cap is attachable to the nozzle surface to cover the first nozzles and includes an end portion that is contactable with the nozzle surface when attached to the nozzle surface. The suction device is connected to the cap. The capping mechanism is attachable the cap to the nozzle surface and separate the cap from the nozzle surface. The memory stores a suction position, a free suction position, and a minute open position beforehand. The suction position is a position of the cap at which the end portion of the cap is in contact with the nozzle surface and ink in the first nozzles is sucked by the suction device. The free suction position is a position of the cap at which the end portion of the cap is separated from the nozzle surface and ink in the first nozzles is not sucked by the suction device. The minute open position is located between the suction position and the free suction position. The controller is configured or programmed to perform a suction process, a movement process, and a minute open position process. In the suction process, ink is sucked from the first nozzles with the cap located at the suction position. In the movement process, the cap is moved toward the minute open position after the suction process. In the minute open position process, movement of the cap is stopped and the suction device is stopped with the cap located at the minute open position, after the movement process.

In each of the ink jet printers described above, a negative pressure adjustment process as described above is not performed after the suction process, and the minute open position process is performed. In the suction process, a negative pressure is generated in the cap by driving the suction device. With the negative pressure generated in the cap, the cap is moved to the minute open position in the movement process and the minute open position process is performed. Immediately after the minute open position process is performed, the pressure in the cap is a negative pressure, and thus, ink in the cap is sucked. As described above, in each of the ink jet printers, no negative pressure adjustment process is performed, and the minute open position process in which ink in the cap is sucked is performed. Thus, the time necessary for the negative pressure adjustment process can be reduced so that a time having the possibility of entering of ink in the cap into the nozzle can be reduced. Accordingly, ink in the cap does not easily enter the nozzle. In each of the ink jet printers, at the minute open position at which the cap is located in the minute open position process, the end portion of the cap is closer to the nozzle surface than at the free suction position. Thus, the cap between the nozzle surface and the cap can be relatively small so that ink in the cap does not easily spatter to the outside.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 16 is a table showing a cap position in each process of cleaning, contacts of a cap end and an absorber with a nozzle surface, a pressure in the cap, driving of a suction pump, and an amount of movement of the cap per a unit time in each of first and second movement processes.

DETAILED DESCRIPTION OF THE PREFERRED EMBODIMENTS

Figure 1:
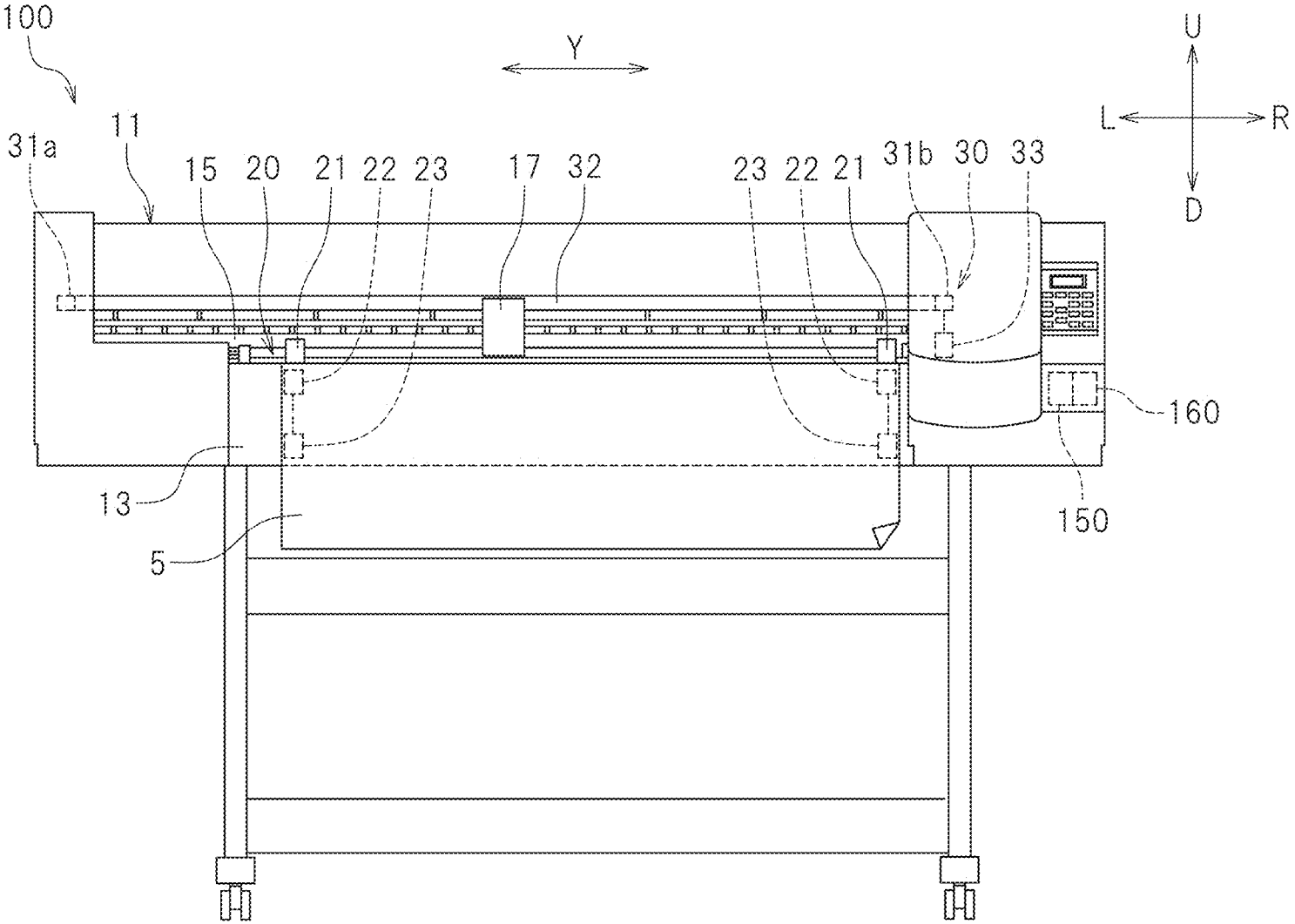
FIG. 1 is a front view of an ink jet printer according to a preferred embodiment of the present invention.

Preferred embodiment of ink jet printers according to the present disclosure will be described hereinafter with reference to the drawings. The preferred embodiments described here are, of course, not intended to particularly limit the present teaching. Elements, portions and features having the same functions are denoted by the same reference numerals, and description for the same elements, portions and features will not be repeated or will be simplified as appropriate.

FIG. 1 is a front view of an ink jet printer 100 according to the present preferred embodiment. In the following description, characters F, Rr, L, R, U, and D in the drawings represent front, rear, left, right, upward, and downward, respectively, when the printer 100 is seen from the front. Character Y represents main scanning directions in the drawings. In this preferred embodiment, the main scanning directions Y are left-right directions. The main scanning directions Y are directions along which ink heads 41 through 44 move. Character X in the drawings represents sub-scanning directions. In this preferred embodiment, the sub-scanning directions X are front-rear directions, and are orthogonal to the main scanning directions Y in plan view. The sub-scanning directions X are directions along which a medium 5 is conveyed. It should be noted that the directions described above are defined simply for convenience of description, and are not intended to limit the state of installation of the printer 100 and do not limit the present teaching.

The printer 100 is an ink jet printer. The printer 100 performs printing on the medium 5. The medium 5 is, for example, a rolled recording sheet. The medium 5 is, however, not limited to the rolled recording sheet, and may be a recording paper sheet, a sheet or film of a resin such as polyvinyl chloride or polyester, a plate material, a fabric such as a woven fabric or a nonwoven fabric, and other types of media.

As illustrated in FIG. 1, the printer 100 includes, a printer body 11, a platen 13, a conveyance mechanism 20, a guide rail 15, a carriage 17, a head moving mechanism 30, the ink heads 41 through 44 (see FIG. 2), ink supply systems 61 through (see FIG. 3), a cleaning system 90 (see FIG. 7), a memory 150, and a controller 160.

The printer body 11 includes a casing extending along the main scanning directions Y. The platen 13 supports the medium 5. The medium 5 is placed on the platen 13. Printing is performed on the platen 13. The platen 13 extends along the main scanning directions Y.

The medium 5 supported by the platen 13 is conveyed by the conveyance mechanism 20 along the sub-scanning directions X. The conveyance mechanism 20 is not limited to a specific configuration. In this preferred embodiment, the conveyance mechanism 20 includes pinching rollers 21, grit rollers 22, and feed motors 23. The pinching rollers 21 are located above the platen 13 and behind the carriage 17, and press the medium 5 from above. The grit rollers 22 are cylindrical members disposed in the platen 13. In this preferred embodiment, the grit rollers 22 are buried in the platen 13 with upper surface portions thereof exposed. The grit rollers 22 face the pinching rollers 21. In this preferred embodiment, the feed motors 23 are connected to the grit rollers 22. When the feed motors 23 are driven with the medium 5 sandwiched between the pinching rollers 21 and the grit rollers 22, the grit rollers 22 rotate. Accordingly, the medium 5 is conveyed along the sub-scanning directions X.

The guide rail 15 is disposed above the platen 13. The guide rail 15 is disposed in parallel or substantially in parallel with the platen 13 and extends along the main scanning directions Y. The carriage 17 is engaged with the guide rail 15. The carriage 17 is slidably disposed on the guide rail 15.

The head moving mechanism 30 causes the carriage 17 and the ink heads 41 through 44 (see FIG. 2) to move along the main scanning directions Y. The head moving mechanism 30 is not limited to a specific configuration. In this preferred embodiment, the head moving mechanism 30 includes left and right pulleys 31*a* and 31*b*, a belt 32, and a carriage motor 33. The left pulley 31*a* is disposed at the left end of the guide rail 15. The right pulley 31*b* is disposed at the right end of the guide rail 15. The belt 32 is an endless belt, and is wound around the left and right pulleys 31*a* and 31*b*. The carriage 17 is attached to the belt 32. In this preferred embodiment, the carriage motor 33 is connected to the right pulley 31*b*. When the carriage motor 33 is driven, the right pulley 31*b* thereby rotates, and the belt 32 runs. Accordingly, the carriage 17 and the ink heads 41 through 44 move along the guide rail 15 in one of the main scanning directions Y.

Figure 2:
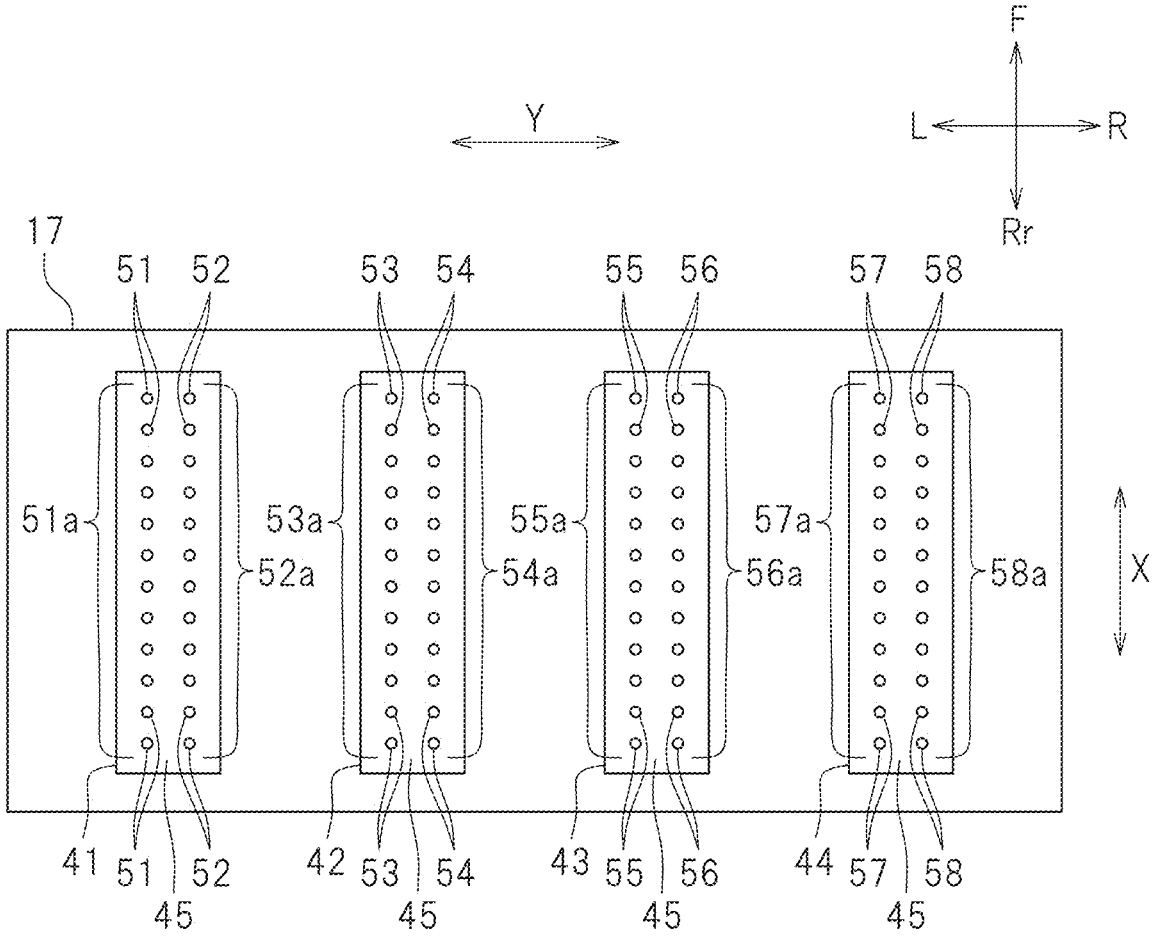
FIG. 2 schematically illustrates a configuration of a lower surface of a carriage.

FIG. 2 schematically illustrates a configuration of a lower surface of the carriage 17. As illustrated in FIG. 2, the ink heads 41 through 44 are disposed in the carriage 17. The ink heads 41 through 44 are held by the carriage 17 with the lower surfaces of the ink heads 41 through 44 exposed. In the following description, the ink heads 41 through 44 will be sometimes referred to as first through fourth ink heads 41 through 44 as necessary. The ink heads 41 through 44 are used to discharge ink. The ink heads 41 through 44 are arranged along the main scanning directions Y. In this preferred embodiment, the first ink head 41, for example, is an example of an ink head according to a preferred embodiment of the present disclosure.

The ink heads 41 through 44 include nozzle surfaces 45. The nozzle surfaces 45 are provided at the lower surfaces of the ink heads 41 through 44. On the nozzle surface 45 of the first ink head 41, a plurality of nozzles 51 are arranged along the sub-scanning directions X, and a plurality of nozzles 52 are arranged along the sub-scanning directions X. Similarly, on the nozzle surface 45 of the second ink head 42, a plurality of nozzles 53 are arranged along the sub-scanning directions X, and a plurality of nozzles 54 are arranged along the sub-scanning directions X. On the nozzle surface 45 of the third ink head 43, a plurality of nozzles 55 are formed along the sub-scanning directions X, and a plurality of nozzles 56 are arranged along the sub-scanning directions X. On the nozzle surface 45 of the fourth ink head 44, a plurality of nozzles 57 are arranged along the sub-scanning directions X, and a plurality of nozzles 58 are arranged along the sub-scanning directions X. Lines of the plurality of nozzles 51 through 58 will be hereinafter referred to as nozzle lines 51*a* through 58*a*. Each of the ink heads 41 through 44 includes two nozzle lines. In this preferred embodiment, the nozzles 51 correspond to first nozzles, and the nozzles 52 correspond to second nozzles, for example.

Figure 3:
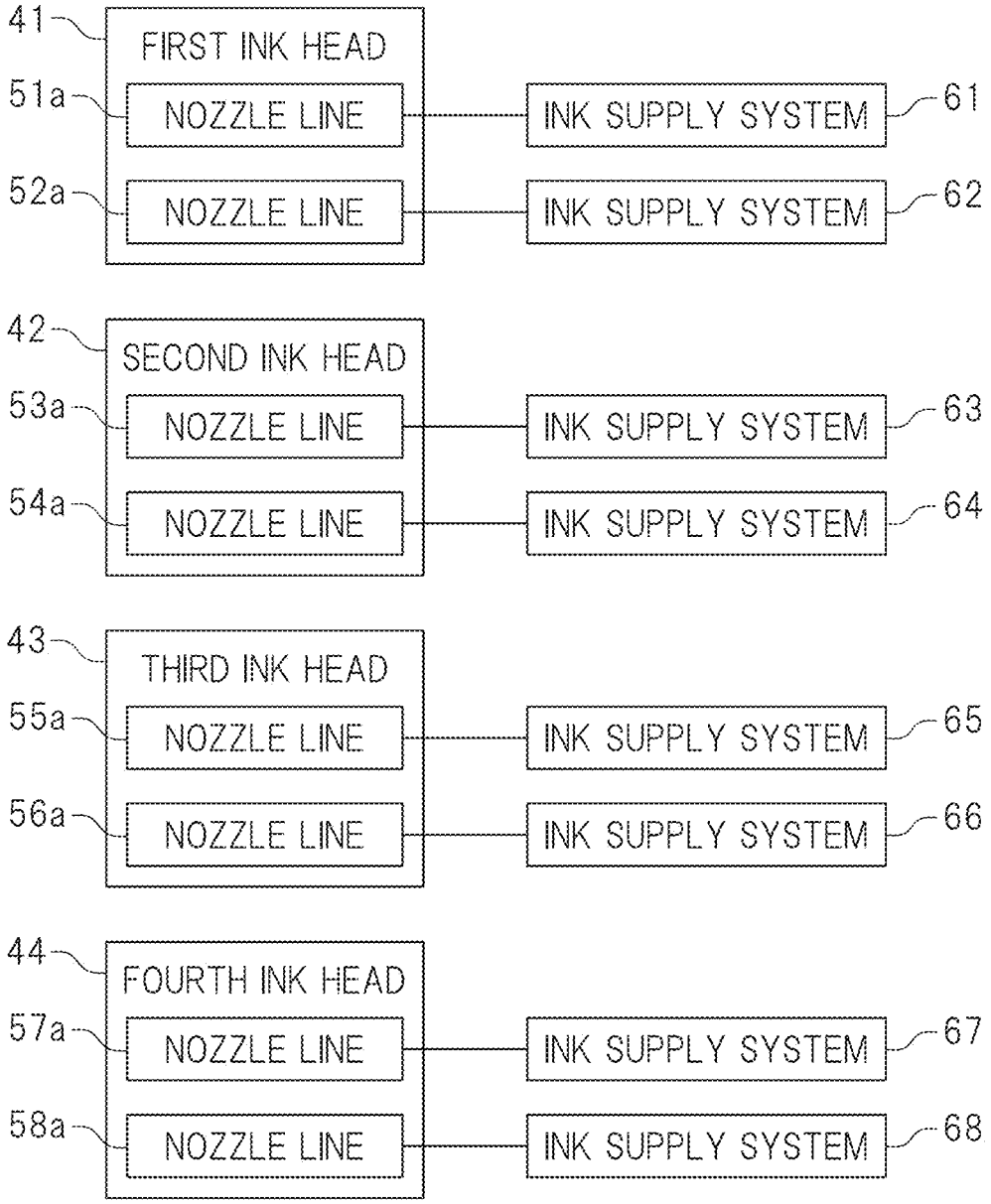
FIG. 3 is a conceptual view showing a relationship between an ink head and an ink supply system.

FIG. 3 is a conceptual view showing a relationship between the ink heads 41 through 44 and the ink supply systems 61 through 68. As shown in FIG. 3, the ink supply systems 61 through 68 are systems that supply ink to the ink heads 41 through 44. The ink supply systems 61 through 68 are provided to the nozzle lines 51*a* through 58*a*, respectively. In this preferred embodiment, since the number of nozzle lines is "8", the number of ink supply systems is also "8", for example. The ink supply systems 61 through 68 are respectively connected to the nozzles 51 through 58 of the nozzle lines 51*a* through 58*a*. In this preferred embodiment, the ink supply systems 61 through 68 preferably have the same configuration. Thus, the following description is directed to the ink supply systems 61 and the 62 for the first ink head 41, and description of the other ink supply systems 63 through 68 will be omitted or simplified. It should be noted that the configuration of some of the ink supply systems 61 through 68 may be different from the configuration of the other of the ink supply systems 61 through 68.

Figure 4:
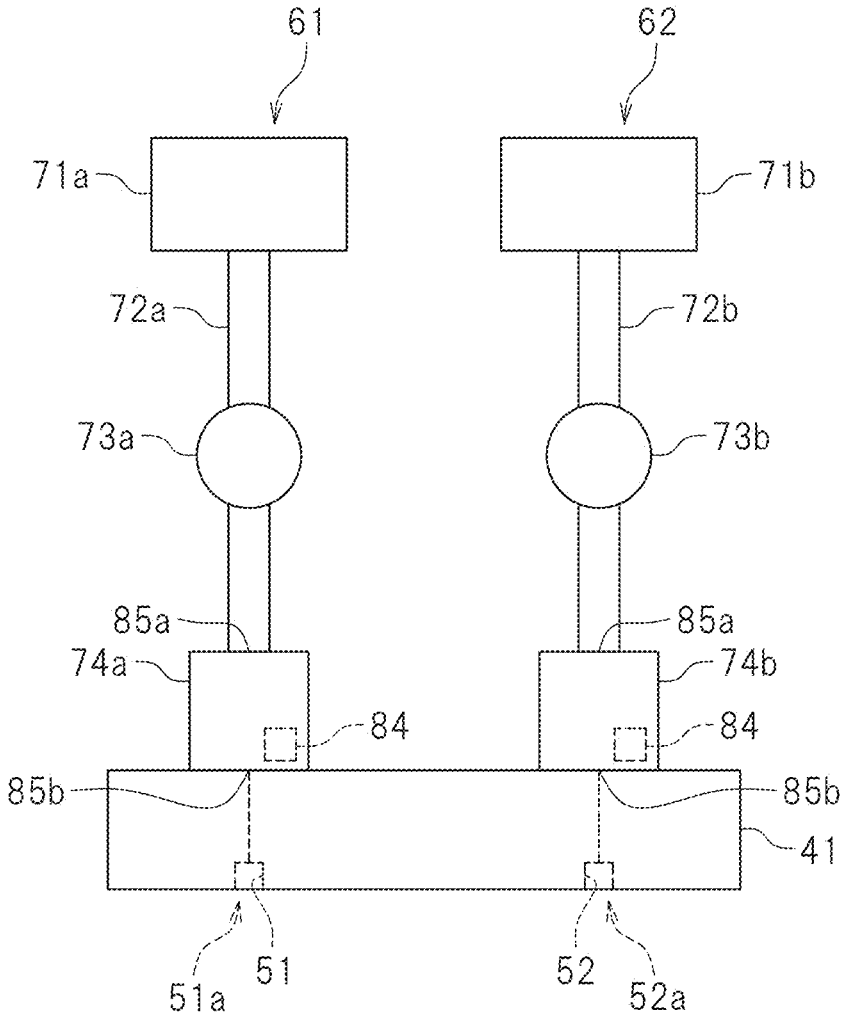
FIG. 4 schematically illustrates a configuration of two ink supply systems for a first ink head.

FIG. 4 schematically illustrates configurations of the ink supply systems 61 and 62 for the first ink head 41. As illustrated in FIG. 4, the ink supply system 61 includes a first ink tank 71*a*, a first ink supply path 72*a*, a first liquid feed pump 73*a*, and a first damper 74*a*. The ink supply system 62 includes a second ink tank 71*b*, a second ink supply path 72*b*, a second liquid feed pump 73*b*, and a second damper 74*b*.

The first ink tank 71*a* is a vessel storing ink. The first ink tank 71*a* stores one of, for example, a process color ink or a spot color ink (e.g., white ink or clear ink). Ink stored in the first ink tank 71*a* is not limited to a specific color. The ink is not limited to a specific material, either. Various materials conventionally used for ink for ink jet printers may be used. The ink may be a solvent-based pigment ink or an aqueous pigment ink, for example. Alternatively, the ink may be an aqueous dye ink or an ultraviolet-curable pigment ink that is cured upon application of ultraviolet rays, for example.

The first ink supply path 72*a* connects the first ink tank 71*a* and the first ink head 41 to each other. One end of the first ink supply path 72*a* is connected to the first ink head 41 through the first damper 74*a*. Specifically, one end of the first ink supply path 72*a* is connected to the nozzles 51 constituting the nozzle line 51*a*, and communicates with the nozzles 51. The other end of the first ink supply path 72*a* is connected to the first ink tank 71*a*. The nozzles 51 of the first nozzle line 51*a* discharge ink stored in the first ink tank 71*a*. The first ink supply path 72*a* is not limited to a specific material. The first ink supply path 72*a* includes, for example, a flexible tube.

The first liquid feed pump 73*a* is disposed on the first ink supply path 72*a*. The first liquid feed pump 73*a* supplies ink stored in the first ink tank 71*a* to the nozzles 51 of the nozzle line 51*a*, and adjusts the pressure to a pressure suitable for discharge of ink from the first ink head 41. In driving, the first liquid feed pump 73*a* feeds ink from the first ink tank 71*a* toward the nozzles 51 of the nozzle line 51*a*. The first liquid feed pump 73*a* is not limited to a specific type, and is, for example, a diaphragm pump or a tube pump.

The first damper 74*a* reduces a pressure variation of ink to stabilize an ink discharge operation of the first ink head 41. The first damper 74*a* detects a flow rate of ink flowing into the first damper 74*a* (i.e., pressure in the first damper 74*a*). Based on the detection result of the ink flow rate, the first liquid feed pump 73*a* is controlled. As illustrated in FIG. 4, the first damper 74*a* is connected to the first ink head 41. In this preferred embodiment, the first damper 74*a* is disposed on top of the first ink head 41. The first damper 74*a* is not limited to a specific configuration.

Figure 5:
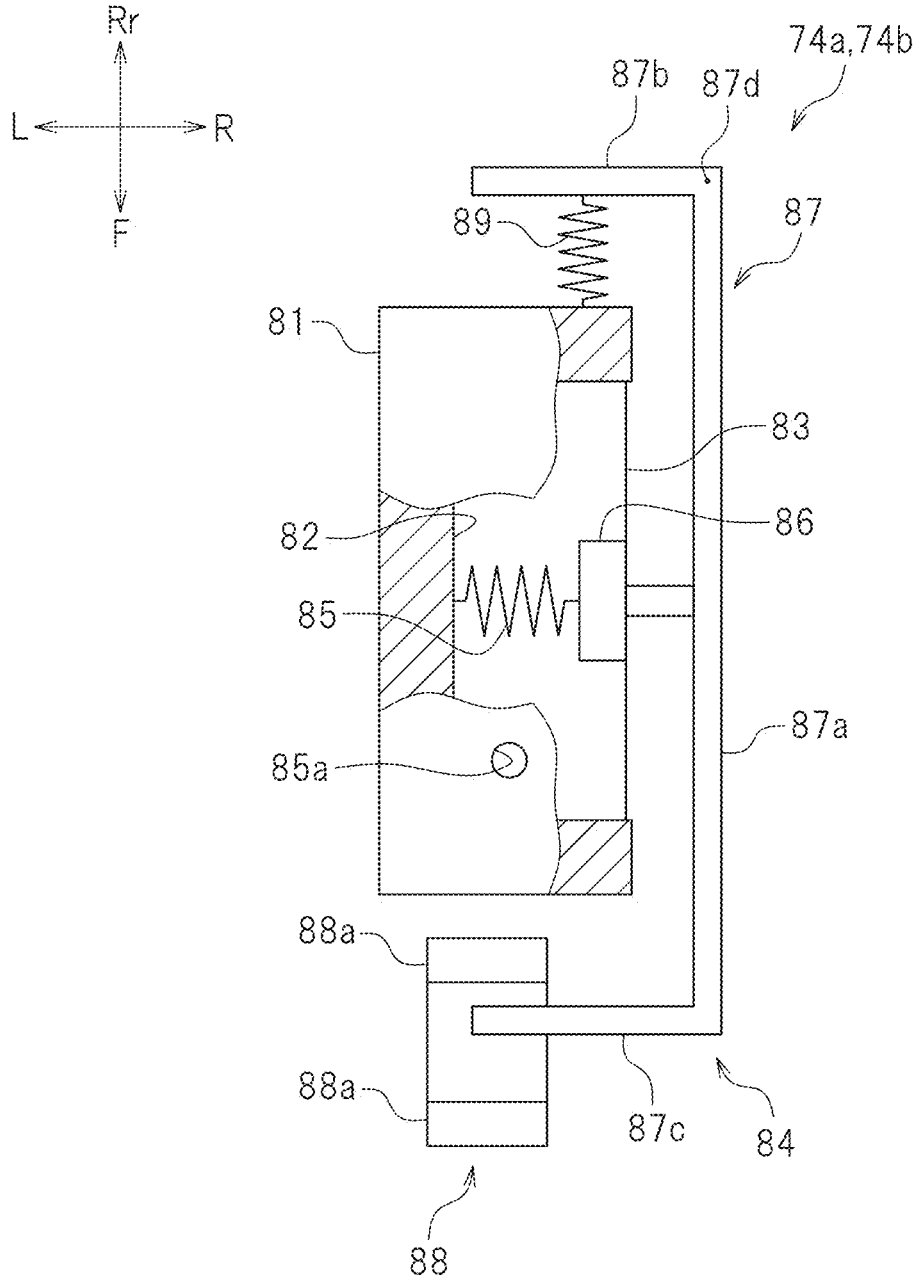
FIG. 5 is a plan view of a damper and illustrates a state where a pressure of a reservoir is a predetermined determination pressure or less.
Figure 6:
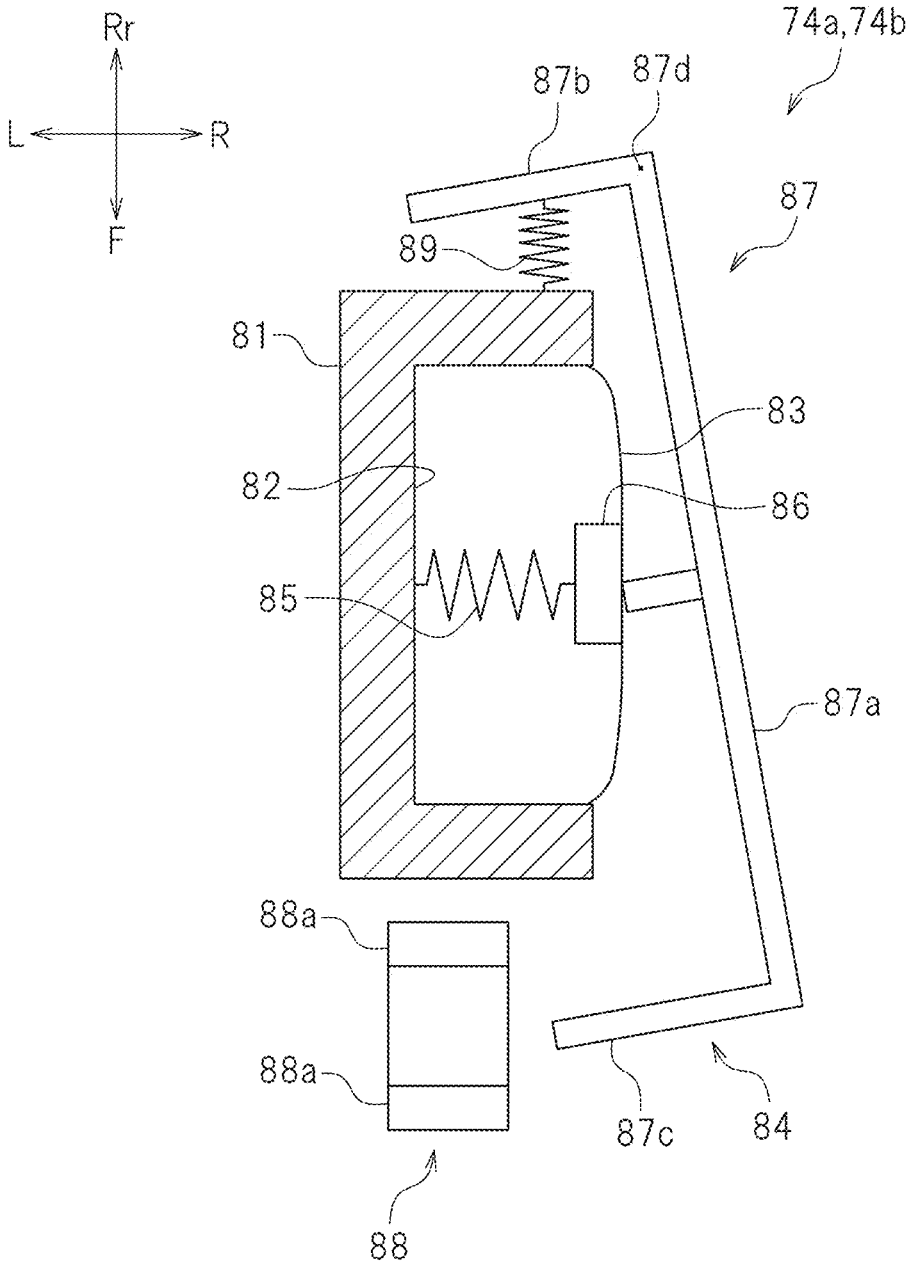
FIG. 6 is a cross-sectional plan view of the damper, and illustrates a state where the pressure of the reservoir is higher than the predetermined determination pressure.

FIG. 5 is a plan view of the dampers 74*a* and 74*b*, and illustrates a state where the pressure of the reservoir 82 is a predetermined determination pressure or less. FIG. 6 is a cross-sectional plan view of the dampers 74*a* and 74*b*, and illustrates a state where the pressure of the reservoir 82 is higher than the predetermined determination pressure. In this preferred embodiment, as illustrated in FIG. 5, the first damper 74*a* includes a damper body 81, the reservoir 82, a damper film 83, and a detection mechanism 84.

The damper body 81 is hollow. The reservoir 82 is provided inside the damper body 81, and partially has an opening. The reservoir 82 temporarily stores ink. The reservoir 82 communicates with the first ink supply path 72*a* (see FIG. 4) and the first ink head 41 (see FIG. 4). In this preferred embodiment, an inlet 85*a* connected to the first ink supply path 72*a* is provided in an upper portion of the damper body 81, and an outlet 85*b* (see FIG. 4) connected to the first ink head 41 is formed in a lower portion of the damper body 81. The locations of the inlet 85*a* and the outlet 85*b* are not specifically limited. In this preferred embodiment, the first damper 74*a* is configured such that ink that has flowed into the reservoir 82 from the inlet 85*a* in printing flows to the first ink head 41 through the outlet 85*b*.

As illustrated in FIG. 5, the damper film 83 is provided to the damper body 81 to cover the opening of the reservoir 82. In this preferred embodiment, a space surrounded by the damper film 83 and the damper body 81 is the reservoir 82. The damper film 83 is made of, for example, a flexible resin film. As illustrated in FIGS. 5 and 6, the damper film 83 is deformable inward and outwards from the reservoir 82 in accordance with the amount of ink stored in the reservoir 82 and/or the pressure in the reservoir 82. The damper film 83 is provided to the damper body 81 with such a tensile stress that enables the damper film 83 to bend inward and outward of the reservoir 82.

In this preferred embodiment, as illustrated in FIG. 5, the reservoir 82 is provided with a spring 85. The spring 85 is disposed in the reservoir 82 in a compressed state and applies an elastic force toward the damper film 83. The spring 85 herein is connected to the surface of the damper film 83 toward the reservoir 82. The spring 85 is not limited to a specific type. The spring 85 is, for example, a coil spring.

The detection mechanism 84 detects a pressure in the reservoir 82. In this preferred embodiment, the detection mechanism 84 indirectly detects a pressure in the first ink supply path 72*a* (see FIG. 4) by detecting the pressure in the reservoir 82. The detection mechanism 84 is not limited to a specific configuration. In this preferred embodiment, the detection mechanism 84 includes a pressing body 86, a filler 87, and a filler sensor 88. The pressing body 86 is provided to the damper film 83. In this preferred embodiment, the pressing body 86 is disposed on a surface of the damper film 83 toward the reservoir 82. The pressing body 86 is supported by the spring 85, and is movable inward and outward from the reservoir 82 together with a bend of the damper film 83.

The filler 87 is disposed in the damper body 81 such that the filler 87 can contact the damper film 83 or the pressing body 86. In this preferred embodiment, the damper body 81 is provided with a support spring 89. The filler 87 is supported by the support spring 89. The filler 87 is not limited to a specific shape. The filler 87 herein has a substantially U shape. Specifically, the filler 87 includes a contact portion 87*a* extending along the front-rear directions at the right of the pressing body 86, a support portion 87*b* extending leftward from the rear of the contact portion 87*a*, and a detected portion 87*c* extending leftward from the front of the contact portion 87*a*. The contact portion 87*a* contacts the damper film 83 or the pressing body 86. The support portion 87*b* is supported by the support spring 89. The detected portion 87*c* is detected by the filler sensor 88.

The filler sensor 88 detects a pressure in the reservoir 82 by detecting the position of the filler 87. The filler sensor 88 indirectly detects a pressure of the first ink supply path 72*a* by detecting the pressure in the reservoir 82. The filler sensor 88 of the first damper 74*a* herein is an example of a pressure detection mechanism. In this preferred embodiment, the filler sensor 88 is a non-contact type sensor, but may be a contact-type sensor. In this preferred embodiment, the filler sensor 88 includes a pair of detectors 88*a*. As illustrated in FIG. 5, while the detected portion 87*c* of the filler 87 is located between the pair of detectors 88*a*, the filler sensor 88 detects that the pressure in the reservoir 82 is a predetermined determination pressure or less.

As illustrated in FIG. 6, as the pressure in the reservoir 82 increases, the damper film 83 bends outward from the reservoir 82. At this time, the pressing body 86 pushes the filler 87 outward from the reservoir 82 so that the filler 87 thus rotates about a shaft 87*d* located between the contact portion 87*a* and the support portion 87*b*. When the pressure in the reservoir 82 then increases and exceeds the predetermined determination pressure, the detected portion 87*c* of the filler 87 moves to a position deviated from the position between the pair of detectors 88*a* of the filler sensor 88. While the detected portion 87*c* of the filler 87 is not located between the pair of detectors 88*a*, the filler sensor 88 detects that the pressure in the reservoir 82 is higher than the predetermined determination pressure. In this preferred embodiment, the range between the pair of detectors 88*a* in the first damper 74*a* corresponds to a predetermined range of the present teaching.

In this preferred embodiment, as illustrated in FIG. 5, while the detected portion 87*c* of the filler 87 is located between the pair of detectors 88*a* of the filler sensor 88, that is, the pressure in the reservoir 82 is the predetermined determination pressure or less, this state is referred to as "the filler 87 hits." On the other hand, as illustrated in FIG. 6, while the detected portion 87*c* of the filler 87 is not located between the pair of detectors 88*a* of the filler sensor 88, that is, the pressure in the reservoir 82 is higher than the predetermined determination pressure, this state is referred to as "the filler 87 is unhit."

As illustrated in FIG. 4, the ink supply system 62 has a configuration similar to that of the ink supply system 61. In the ink supply system 62, the second ink tank 71*b*, the second ink supply path 72*b*, the second liquid feed pump 73*b*, and the second damper 74*b* respectively have the same configurations of the first ink tank 71*a*, the first ink supply path 72*a*, the first liquid feed pump 73*a*, and the first damper 74*a* of the ink supply system 61.

In this preferred embodiment, the second ink tank 71*b* stores ink different from ink stored in the first ink tank 71*a*. The "different inks" herein refers to inks having different components. For example, "different inks" have different colors. However, even with the same color, if components of inks are different, these inks are defined as "different inks." In this preferred embodiment, the nozzles 51 and the nozzles 52 discharge different inks. Alternatively, the nozzles 51 and the nozzles 52 may discharge the same ink. The ink stored in the second ink tank 71*b* is an example of another ink.

Although not specifically described, as illustrated in FIG. 3, the two ink supply systems 63 and 64 for the second ink head 42, the two ink supply systems 65 and 66 for the third ink head 43, and the two ink supply systems 67 and 68 for the fourth ink head 44 have the same configuration as that of the ink supply system 61. All the inks supplied from these ink supply systems 61 through 68 may be different inks, or some of the inks supplied from these ink supply systems 61 through 68 may be the same ink.

Figure 7:
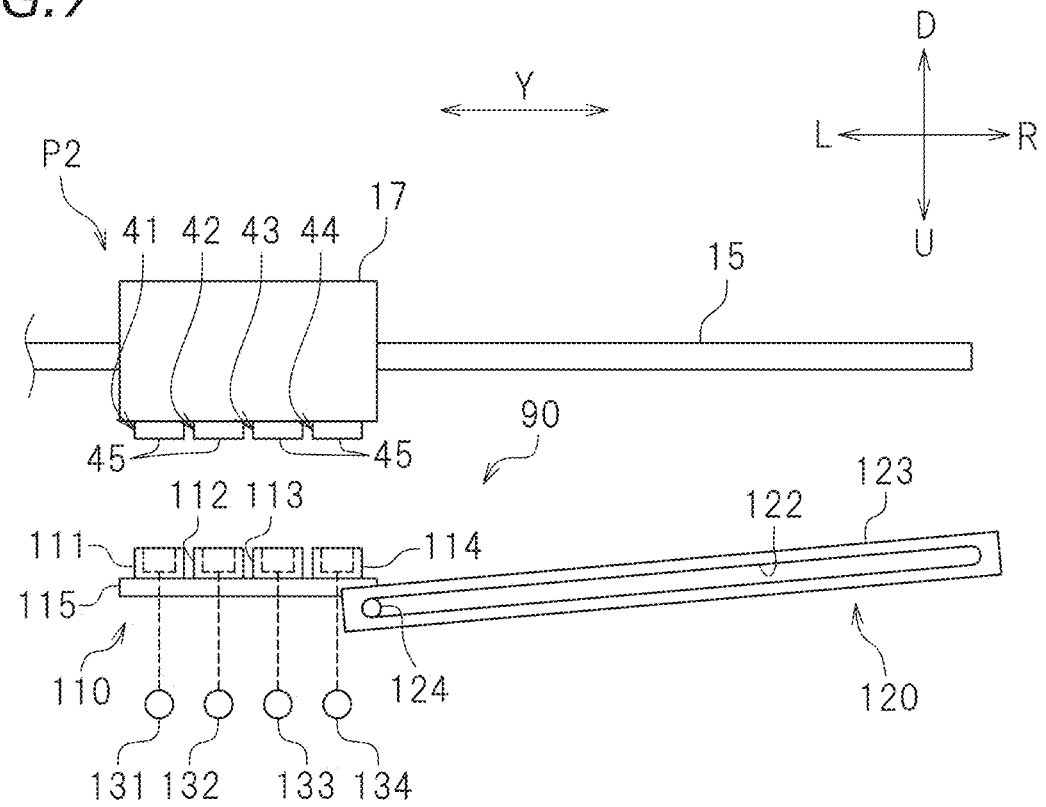
FIG. 7 is a front view of an ink head and a cap assembly.
Figure 8:
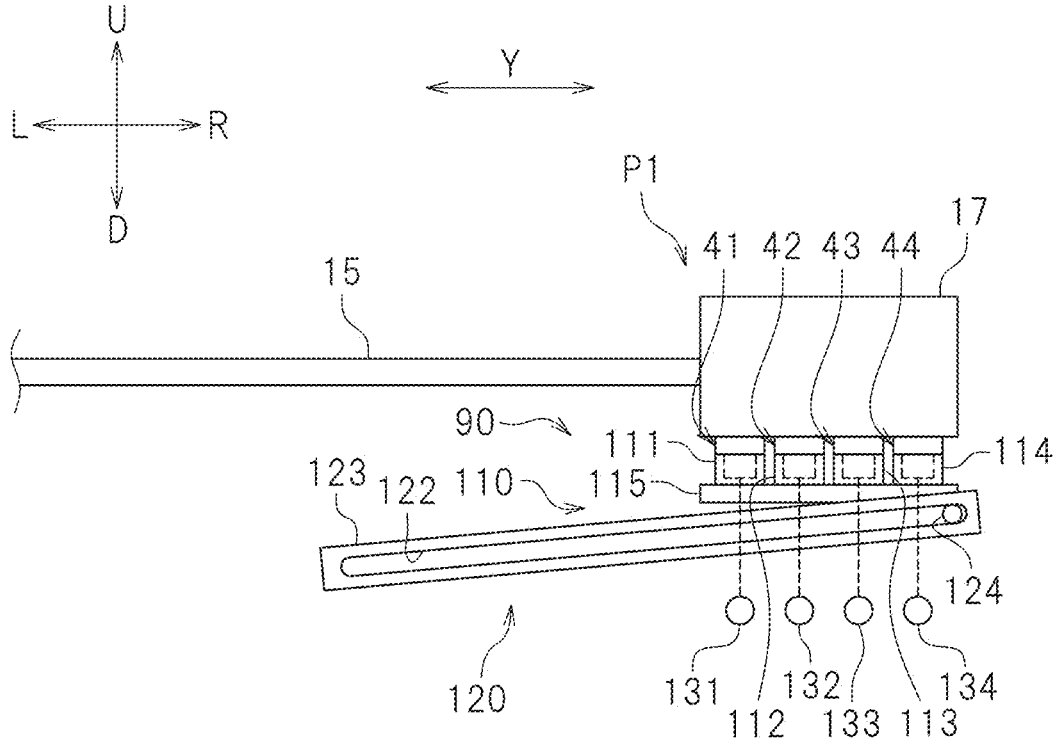
FIG. 8 is a front view of the ink head and the cap assembly.
Figure 9:
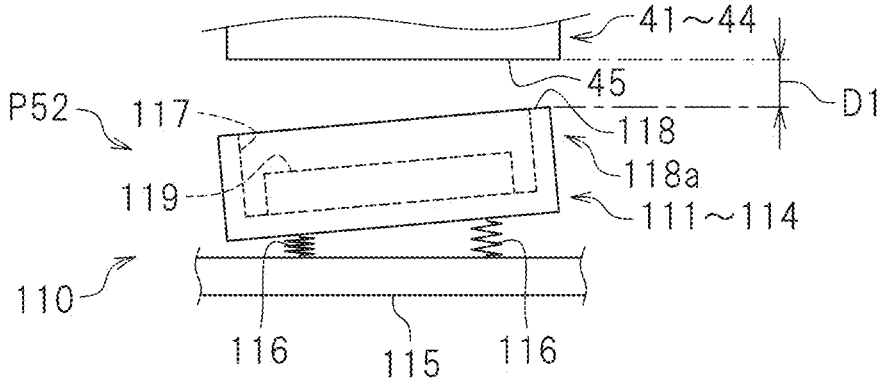
FIG. 9 is a front view showing a positional relationship between a cap and a nozzle surface, and illustrates a free suction position.
Figure 10:
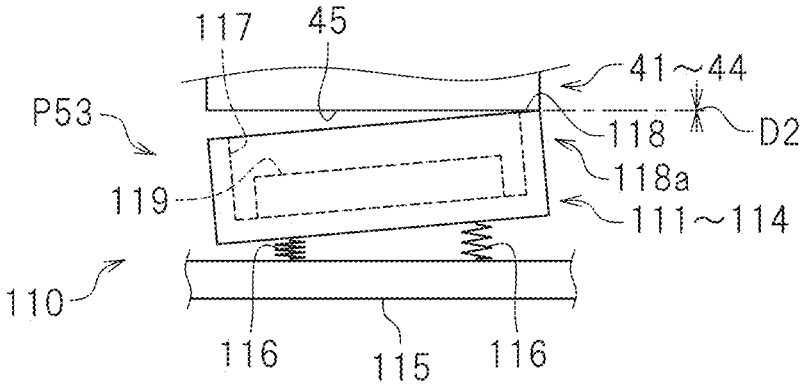
FIG. 10 is a front view showing a positional relationship between the cap and the nozzle surface, and illustrates a minute open position.
Figure 11:
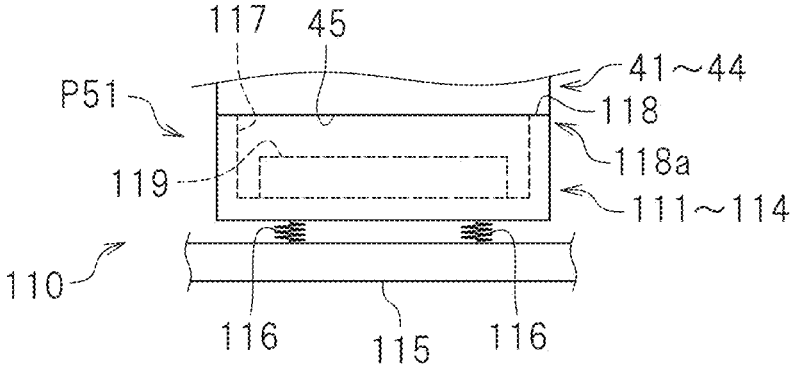
FIG. 11 is a front view showing a positional relationship between the cap and the nozzle surface, and illustrates a suction position.
Figure 12:
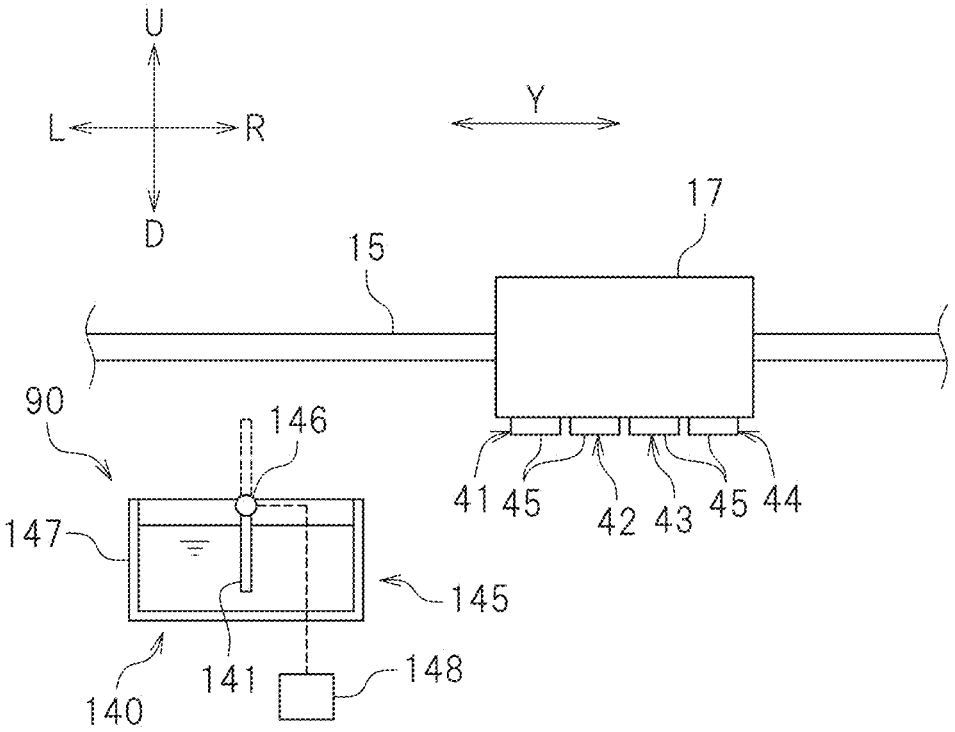
FIG. 12 is a front view of the ink head and a wiper assembly.

FIGS. 7 and 8 are front views of the ink heads 41 through 44 and a cap assembly 110. FIG. 7 is a view when the ink heads 41 through 44 are located at a second position P2. FIG. 8 is a view when the ink heads 41 through 44 are located at a first position P1. FIGS. 9, 10, and 11 are front views showing a positional relationship between caps 111 through 114 and the nozzle surfaces 45. FIG. 12 is a front view of the ink heads 41 through 44 and a wiper assembly 140.

Next, the cleaning system 90 will be described. As illustrated in FIGS. 7 and 12, the cleaning system 90 is used to clean the ink heads 41 through 44. The cleaning system 90 includes the cap assembly 110 and the wiper assembly 140.

As illustrated in FIG. 7, the cap assembly 110 includes the first through fourth caps 111 through 114, a base 115, springs 116 (see FIG. 9), a capping mechanism 120, and first through fourth suction pumps 131 through 134. As illustrated in FIG. 8, the caps 111 through 114 are attachable to the nozzle surfaces 45 of the ink heads 41 through 44, respectively. The "attached" herein refers to a state where the nozzles 51 through 58 are surrounded by the caps 111 through 114 in a bottom view, that is, a state where end portions 118 (see FIG. 9) of the caps 111 through 114 are in contact with the nozzle surfaces 45 such that each end portion 118 defines a ring shape. The "attached" refers to a state in which the entire upper ends of the end portions 118 of the caps 111 through 114 are in contact with the nozzle surfaces 45 and no gaps are present between the end portions 118 of the caps 111 through 114 and the nozzle surfaces 45. Each of the caps 111 through 114 covers the nozzles 51 through 58 (see FIG. 2). For example, the first cap 111 covers the nozzles 51 and the nozzles 52 in the nozzle surface 45 of the first ink head 41.

In this preferred embodiment, the caps 111 through 114 have the same configuration. Thus, only the configuration of the cap 111 is described here, and the configurations of the caps 112 through 114 will not be described. As illustrated in FIG. 9, the cap 111 includes a hollow portion. The cap 111 includes an opening 117 in an upper portion thereof, and the end portion 118 surrounding the opening 117. The end portion 118 defines an upper portion of the cap 111. As illustrated in FIG. 11, when the cap 111 is attached to the nozzle surface 45, the end portion 118 contacts the nozzle surface 45. Materials for the cap 111 are not specifically limited. At least a portion of the cap 111 to contact with the nozzle surface 45 (end portion 118 herein) is made of, for example, rubber.

In this preferred embodiment, the cap assembly 110 includes absorbers 119. The absorbers 119 are disposed in the caps 111 through 114. The absorbers 119 herein are preferably located on the bottom surfaces of the caps 111 through 114. The absorbers 119 absorb ink in the caps 111 through 114. In this preferred embodiment, the absorbers 119 are housed in the caps 111 through 114, and upper ends of the absorbers 119 are located below the upper ends of the end portions 118. Thus, while the caps 111 through 114 are attached to the nozzle surfaces 45, the absorbers 119 are not in contact with the nozzle surfaces 45. The absorbers 119 are not limited to a specific type. The absorbers 119 are, for example, sponges. FIGS. 7 and 8 do not show the absorbers 119.

As illustrated in FIG. 8, the first position P1 at which the ink heads 41 through 44 are kept on standby in a printing standby mode is set at a right end portion of the guide rail 15. The first position P1 is a so-called home position. While the ink heads 41 through 44 are located at the first position P1, the caps 111 through 114 are attached to the nozzle surfaces 45 of the ink heads 41 through 44, respectively.

As illustrated in FIG. 7, the caps 111 through 114 are supported by the base 115. The base 115 is located below the caps 111 through 114. The base 115 is not limited to a specific shape, and is a plate-shaped structure herein. In this preferred embodiment, as illustrated in FIG. 9, springs 116 are disposed between the cap 111 and the base 115. Although not shown, the springs 116 are also disposed between the base 115 and each of the caps 112 through 114. The number of the springs 116 is not limited to a specific number. In this preferred embodiment, two springs 116 are provided to each of the caps 111 through 114. The springs 116 are not shown in FIGS. 7 and 8. The springs 116 exert an elastic force from the base 115 toward the cap 111.

In this preferred embodiment, as illustrated in FIG. 9, while the cap 111 is not attached to the nozzle surface 45, that is, the cap 111 is separated from the nozzle surface 45, the cap 111 is tilted relative to the nozzle surface 45. In other words, while the cap 111 is separated from the nozzle surface 45, the upper end surface of the end portion 118 of the cap 111 is tilted. In this preferred embodiment, as illustrated in FIG. 10, while a portion of the end portion 118 is in contact with the nozzle surface 45, the cap 111 is also tilted relative to the nozzle surface 45. The "separated" herein refers to a state where the end portions 118 of the caps 111 through 114 are not completely in contact with the nozzle surfaces 45. The "separated" refers to a state where a gap is provided between the nozzle surfaces 45 and the end portions 118 of the caps 111 through 114 entirely.

In the following description, a portion of the end portion 118 of the cap 111 located at the highest position will be referred to as an uppermost end 118*a* (see FIG. 10). In this preferred embodiment, when the cap 111 is brought into contact with the nozzle surface 45, the uppermost end 118*a* of the end portion 118 first contacts the nozzle surface 45, as illustrated in FIG. 10. Thereafter, when the cap 111 further rises, the uppermost end 118*a* is pressed against the nozzle surfaces 45 so that the right spring 116 shrinks and the cap 111 tilts to be horizontally oriented. Subsequently, as illustrated in FIG. 11, while the cap 111 is attached to the nozzle surface 45, the cap 111 is oriented horizontally or substantially horizontally. This configuration also holds for the caps 112 through 114.

As illustrated in FIGS. 7 and 8, the capping mechanism 120 causes the caps 111 through 114 to be attached to or separated from the nozzle surfaces 45 of the ink heads 41 through 44. In this preferred embodiment, the capping mechanism 120 lifts and lowers the caps 111 through 114. As illustrated in FIGS. 9 and 10, the capping mechanism 120 moves the caps 111 through 114 while tilting the caps 111 through 114 relative to the nozzle surfaces 45. In this preferred embodiment, the capping mechanism 120 moves the caps 111 through 114 along the main scanning directions Y and upward and downward in conjunction with movement of the ink heads 41 through 44 along the main scanning directions Y. Alternatively, the capping mechanism 120 may move the caps 111 through 114 upward and downward with the position of the ink heads 41 through 44 fixed.

As illustrated in FIG. 7, the second position P2 is set at a right end portion of the guide rail 15 and at the left of the first position P1. The second position P2 is not located directly above the platen 13 (see FIG. 1). While the ink heads 41 through 44 move from the second position P2 to the first position P1, the capping mechanism 120 causes the caps 111 through 114 to move toward the nozzle surfaces 45 of the ink heads 41 through 44 while moving the caps 111 through 114 from the second position P2 to the first position P1. On the other hand, while the ink heads 41 through 44 move from the first position P1 to the second position P2, the capping mechanism 120 causes the caps 111 through 114 to be separated from the nozzle surfaces 45 of the ink heads 41 through 44 while moving the caps 111 through 114 from the first position P1 to the second position P2. In this preferred embodiment, "controlling the capping mechanism 120" refers to an operation of controlling the head moving mechanism 30 such that the caps 111 through 114 are attached to or separated from the nozzle surfaces 45 in conjunction with movement of the ink heads 41 through 44 along the main scanning directions Y.

The capping mechanism 120 is not limited to a specific configuration. In this preferred embodiment, the capping mechanism 120 includes a guide 123 with a guide hole 122 extending obliquely upward from the second position P2 toward the first position P1, and a support shaft 124 that is engaged with the guide hole 122 and disposed in the base 115. For example, the carriage 17 includes a contact portion (not shown) that contacts the base 115 between the second position P2 and the first position P1.

While the ink heads 41 through 44 move from the second position P2 to the first position P1, the contact portion of the carriage 17 pushes the base 115 toward the first position P1. At this time, the base 115 and the caps 111 through 114 move toward the nozzle surfaces 45 while being guided by the guide hole 122, and move from the second position P2 toward the first position P1. In this movement, the positions of the nozzle surfaces 45 of the ink heads 41 through 44 and the caps 111 through 114 change in the order of FIG. 9, FIG. 10, and FIG. 11. Then, as illustrated in FIG. 8, when the ink heads 41 through 44 reach the first position P1, the caps 111 through 114 are attached to the nozzle surfaces 45 of the ink heads 41 through 44 (see FIG. 11). On the other hand, while the carriage 17 and the ink heads 41 through 44 move from the first position P1 to the second position P2, the contact portion of the carriage 17 also moves from the first position P1 to the second position P2. At this time, the base 115 and the caps 111 through 114 move away from the nozzle surfaces 45 while being guided by the guide hole 122, and move from the first position P1 toward the second position P2 with the base 115 being in contact with the contact portion of the carriage 17. In this movement, the positions of the nozzle surfaces 45 of the ink heads 41 through 44 and the caps 111 through 114 change in the order of FIG. 11, FIG. 10, and FIG. 9. As illustrated in FIG. 7, when the caps 111 through 114 reach the second position P2, the caps 111 through 114 are held standby at the second position P2.

As illustrated in FIG. 7, the suction pumps 131 through 134 are respectively connected to the caps 111 through 114. The suction pumps 131 through 134 suck ink, air, or the like in the caps 111 through 114, respectively. In this preferred embodiment, for example, the suction pump 131 is an example of a suction device. The suction pumps 131 through 134 are, for example, vacuum pumps. The suction pumps 131 through 134 are connected to the bottom surfaces of the caps 111 through 114 through tubes or the like. In driving, the suction pumps 131 through 134 generate a negative pressure lower than a negative pressure in the ink supply paths connected to the corresponding ink heads 41 through 44. For example, when the suction pumps 131 through 134 are driven with the caps 111 through 114 attached to the ink heads 41 through 44, ink or the like is sucked from the nozzles 51 through 58 of the ink heads 41 through 44. The ink or the like sucked by the suction pumps 131 through 134 is discarded to an waste liquid tank through unillustrated tubes or the like.

As illustrated in FIG. 12, the wiper assembly 140 is used to wipe the nozzle surfaces 45 of the ink heads 41 through 44. The wiper assembly 140 includes a wiper 141 and a wiping mechanism 145. The wiper 141 and the wiping mechanism 145 are disposed between the platen 13 (see FIG. 1) and the ink heads 41 through 44 located at the second position P2 (see FIG. 7) in the main scanning directions Y. The wiper 141 and the wiping mechanism 145 are used to clean by wiping the nozzle surfaces 45 of the ink heads 41 through 44. The wiper 141 is a member to wipe the nozzle surfaces 45 of the ink heads 41 through 44. The wiper 141 is a flat plate extending along the front-rear directions and upward and downward. The length of the wiper 141 in the front-rear directions is longer than the length of the ink heads 41 through 44 in the front-rear directions. The wiper 141 is made of, for example, rubber.

The wiping mechanism 145 supports the wiper 141 and causes the wiper 141 to contact the nozzle surfaces 45 of the ink heads 41 through 44 and to be separated from the nozzle surfaces 45 of the ink heads 41 through 44. The wiping mechanism 145 includes a rotation shaft 146, a cleaning solution tank 147, and a rotation motor 148. The rotation shaft 146 supports and is connected to one end of the wiper 141. The wiper 141 is rotatable about the rotation shaft 146. The rotation shaft 146 extends along the front-rear directions. When the wiper 141 is located at a rotation position at which a distal end of the wiper 141 from the rotation shaft 146 is located above the other end, the distal end is located slightly higher than the nozzle surfaces 45 of the ink heads 41 through 44. In view of this, when the carriage 17 runs with the wiper 141 located at such a rotation position, the wiper 141 can wipe the nozzle surfaces 45 of the ink heads 41 through 44. On the other hand, when the wiper 141 is located at a rotation position at which the distal end of the wiper 141 from the rotation shaft 146 is located below the other end, the wiper 141 is immersed in a cleaning solution in the cleaning solution tank 147 disposed below the rotation shaft 146. The wiper 141 is rotated by the rotation motor 148.

In this preferred embodiment, the head moving mechanism 30 moves the ink heads 41 through 44 along the main scanning directions Y to move the ink heads 41 through 44 along the main scanning directions Y relative to the wiper 141.

Next, the memory 150 (see FIG. 1) and the controller 160 (see FIG. 1) will be described. The memory 150 stores various parameters, for example. The controller 160 performs control concerning printing and control concerning cleaning of the ink heads 41 through 44. The memory 150 and the controller 160 are not limited to specific configurations. In this preferred embodiment, the memory 150 and the controller 160 are defined by, for example, microcomputers. Each microcomputer is not limited to a specific hardware configuration, and includes, for example, an interface (I/F) that receives printing data and other data from external equipment such as a host computer, a central processing unit (CPU) that executes an instruction of a control program, a read only memory (ROM) that stores programs to be executed by the CPU, a random access memory (RAM) that is used as a working area where programs are developed, and a memory that stores the programs, the data, and so forth. The memory 150 and the controller 160 do not need to be disposed inside the printer 100, and may be computers disposed outside the printer 100 and communicably connected to the printer 100 by wires or wirelessly, for example. In this preferred embodiment, the memory 150 and the controller 160 are preferably defined by one unit, and are communicably connected to each other.

Figure 13:
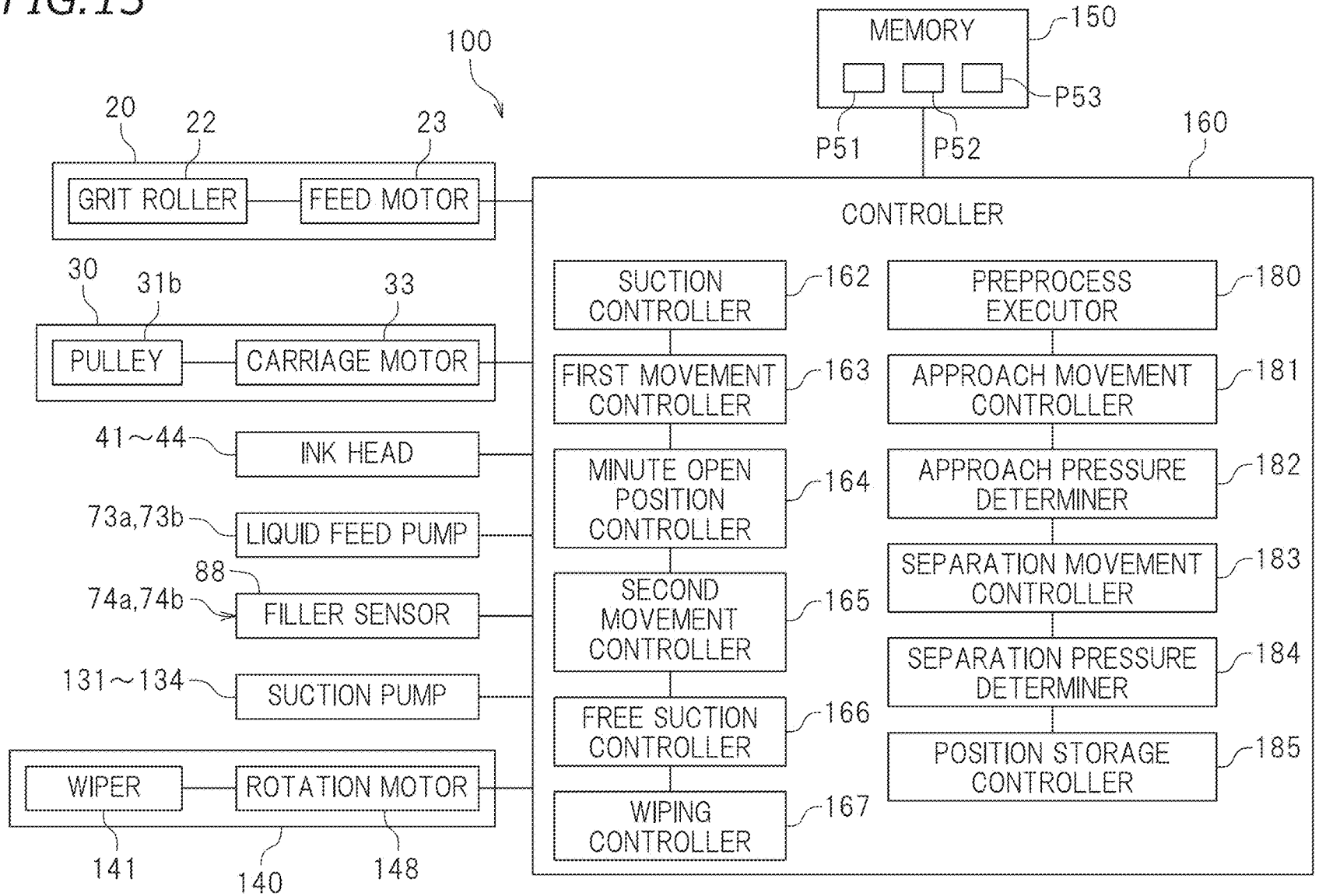
FIG. 13 is a block diagram of the ink jet printer.

FIG. 13 is a block diagram of the printer 100 according to this preferred embodiment. As illustrated in FIG. 13, the controller 160 is communicably connected to the feed motors 23 of the conveyance mechanism 20, the carriage motor 33 of the head moving mechanism 30, the ink heads 41 through 44, the liquid feed pump 73*a* and 73*b*, the filler sensors 88 of the dampers 74*a* and 74*b*, the suction pumps 131 through 134, and the rotation motor 148 of the wiper assembly 140, and can control these components.

In this preferred embodiment, the controller 160 is preferably configured or programmed to include a suction controller 162, a first movement controller 163, a minute open position controller 164, a second movement controller 165, a free suction controller 166, and a wiping controller 167. The components of the controller 160 described above may be defined by software or by hardware. For example, the components may be implemented by a processor or may be incorporated in a circuit. Specific control of the components of the controller 160 will be described later.

The configuration of the printer 100 according to this preferred embodiment has been described above. In performing cleaning on the ink heads 41 through 44, a free suction process is performed. In this preferred embodiment, free suction processes on the ink heads 41 through 44 are the same. Thus, the following description is directed to a free suction process on the ink head 41 and description on free suction processes on the ink head 42 through 44 will be omitted as appropriate.

In the free suction process, the suction pump 131 is driven with the cap 111 separated from the nozzle surface 45 of the ink head 41 so that ink in the cap 111 is sucked and ink in the nozzles 51 and 52 of the ink head 41 are not ejected to the cap 111. In performing the free suction process, the cap 111 can be filled with ink in some cases. Thus, if the free suction process is performed with an excessive gap left between the nozzle surface 45 of the ink head 41 and the cap 111, ink in the cap 111 might leak to the outside. In addition, in detaching the cap 111 from the nozzle surface 45 to which the cap 111 is attached, ink in the cap 111 might spatter to the outside.

In the following description, the gap between the nozzle surface 45 and the cap 111 refers to a distance between the nozzle surface 45 and a portion of the end portion 118 of the cap 111 farthest from the nozzle surface 45. In this preferred embodiment, ink discharged from the nozzles 51 and ink discharged from the nozzles 52 are mixed in the cap 111. The ink in cap 111 might contain dirt or the like attached to the nozzle surface 45. In the free suction process, a negative pressure state is maintained in the nozzles 51 and 52 of the ink head 41. Thus, if the gap between the nozzle surface 45 of the ink head 41 and the cap 111 excessively increases, a portion of ink in the cap 111 might be attached to the nozzle surface 45 at the time when the nozzle surface 45 is separated from the cap 111. The ink attached to the nozzle surfaces 45 is ink of a mixed color containing dirt. At this time, since the inside of the ink head 41 is at a negative pressure, the mixed ink adhering to the nozzle surfaces 45 might be sucked into the nozzles 51 and 52.

Although not directly related to the free suction process, even in a case where the cap between the nozzle surface 45 of the ink head 41 and the cap 111 is zero or excessively small (the cap 111 is completely attached to the nozzle surface 45 in this preferred embodiment), mixed ink in the cap 111 might be sucked into the nozzles 51 and 52. The expression "the cap 111 is completely attached to the nozzle surface 45" refers to a state where no gap is present between the nozzle surface 45 and the end portion 118 of the cap 111, illustrated in FIG. 11.

For the foregoing reasons, if the free suction process is performed, it is preferable to use a configuration in which ink in the cap 111 does not easily spatter to the outside and mixed ink adhering to the nozzle surface 45 is not easily sucked into the nozzles 51 and 52. In view of this, in this preferred embodiment, a minute open position process is performed before the free suction process. This minute open position process will be described later.

In this preferred embodiment, the memory 150 stores a suction position P51 (see FIG. 11), a free suction position P52 (see FIG. 9), and a minute open position P53 (see FIG. 10) beforehand. As illustrated in FIG. 11, the suction position P51 is a position of the cap 111 (specifically a position of the cap 111 in the top-bottom directions) relative to the nozzle surface 45 of the ink head 41 in performing a suction process. The "suction process" herein refers to a process in which ink in the nozzles 51 and 52 of the ink head 41 is sucked and ink in the cap 111 is sucked. The suction position P51 is a position of the cap 111 (specifically a position of the cap 111 in the top-bottom directions) at which the cap 111 is attached to the nozzle surface 45 of the ink head 41 and the entire end portion 118 of the cap 111 is in contact with the nozzle surface 45. The suction position P51 is a position of the cap 111 at which ink in the nozzles 51 and 52 is sucked by the suction pump 131. At the suction position P51, an upper portion of the end portion 118 of the cap 111 is crushed by the nozzle surface 45.

The free suction position P52 illustrated in FIG. 9 is a position of the cap 111 relative to the nozzle surface 45 in performing a free suction process. The free suction position P52 is a position of the cap 111 at which the end portion 118 of the cap 111 is separated from the nozzle surface 45 and the entire end portion 118 of the cap 111 is not contact with the nozzle surface 45. At the free suction position P52, the cap 111 is located below the nozzle surface 45. The free suction position P52 is a position of the cap 111 when ink in the nozzles 51 and 52 is not sucked by the suction pump 131 and ink in the cap 111 is sucked. In other words, the free suction position P52 is a position of the cap 111 at which ink is not sucked from the nozzles 51 and 52 while the suction pump 131 is driven.

The minute open position P53 illustrated in FIG. 10 is a position of the cap 111 relative to the nozzle surface 45 in performing a minute open position process. The minute open position process herein is a process in which ink is not sucked from the nozzles 51 and 52 of the ink head 41 and at least a portion of ink adhering to the nozzle surface 45 is sucked. In this preferred embodiment, the minute open position P53 is a position between the suction position P51 and the free suction position P52. In other words, the minute open position P53 is located below the suction position P51 and above the free suction position P52. At the minute open position P53, the gap between the nozzle surface 45 of the ink head 41 and the cap 111 is at a minute distance with which no ink leaks from the cap 111 and ink in the cap 111 is not sucked into the nozzles 51 and 52. This minute distance is a very minute distance that cannot be visually observed. As described above, in the configuration in which the gap between the nozzle surface 45 and the cap 111 is at the minute distance, when the suction pump 131 is driven, ink in the nozzles 51 and 52 is not easily sucked.

In this preferred embodiment, the minute open position P53 is a position of the cap 111 when a portion of the end portion 118 (uppermost end 118*a* in this preferred embodiment) of the cap 111 is in contact with the nozzle surface 45 and the other portion of the end portion 118 (a portion of the end portion 118 except for the uppermost end 118*a* in this preferred embodiment) is separated from the nozzle surface 45. The expression "a portion of the end portions 118 is in contact" herein includes a state where a portion of the end portion 118 of the cap 111 is directly in contact with the nozzle surface 45 and a state where a portion of the end portion 118 of the cap 111 is indirectly in contact with the nozzle surface 45 through ink (e.g., liquid column of ink). At the minute open position P53, the uppermost end 118*a* of the cap 111 is in contact with the nozzle surface 45, but is not crushed by the nozzle surface 45. Alternatively, the uppermost end 118*a* may be crushed by the nozzle surface 45. In the case where the uppermost end 118*a* is crushed by the nozzle surface 45, another gap is preferably provided between the end portion 118 of the cap 111 and the nozzle surface 45. The minute open position P53 is a position adjusted to obtain a state at which at least a gap is provided between the nozzle surface 45 of the ink head 41 and the end portion 118 of the cap 111, ink in the cap 111 is sucked, ink is not sucked from the nozzles 51 and 52, and at least a portion of ink adhering to the nozzle surface 45 of the ink head 41 can be removed. The case where "ink is not sucked from the nozzles 51 and 52" herein includes a case where no ink is sucked from the nozzles 51 and 52 and a case where a small amount of ink is sucked from the nozzles 51 and 52.

In this preferred embodiment, the minute open position P53 is a position of the cap 111 at which the cap 111 is closest to the nozzle surface 45 among positions of the cap 111 at which ink cannot be sucked from the nozzles 51 and 52 of the ink head 41 in sucking ink in the cap 111. In other words, the minute open position P53 is a position of the cap 111 at which the cap 111 is at the highest position when ink in the nozzles 51 and 52 cannot be sucked among positions of the cap 111 relative to the nozzle surface 45 of the ink head 41. When the cap 111 is moved upward at least to a small extent from the state where the cap 111 is located at the minute open position P53, ink in the nozzles 51 and 52 can be sucked.

In this preferred embodiment, as illustrated in FIGS. 9 and 10, a distance from the nozzle surface 45 to the minute open position P53 (distance in the top-bottom directions in this preferred embodiment) is less than or equal to about 1/10 of the distance from the nozzle surface 45 to the free suction position P52. As illustrated in FIG. 9, the distance between the uppermost end 118*a* of the cap 111 and the nozzle surface 45 at the free suction position P52 is a first distance D1. As illustrated in FIG. 10, the distance between the uppermost end 118*a* of the cap 111 and the nozzle surface 45 at the minute open position P53 is a second distance D2. The second distance D2 includes zero. The second distance D2 is smaller than the first distance D1. In this preferred embodiment, the second distance D2 is, for example, less than or equal to about 1/10 of the first distance D1. The second distance D2 may be less than or equal to about 1/8 of the first distance D1, may be less than or equal to about 1/5 of the first distance D1, and may be less than or equal to about 1/2 of the first distance D1.

In this preferred embodiment, the minute open position P53 is determined by the controller 160. As illustrated in FIG. 13, to perform a process of determining the minute open position P53, the controller 160 is also preferably configured or programmed to include a preprocess executor 180, an approach movement controller 181, an approach pressure determiner 182, a separation movement controller 183, a separation pressure determiner 184, and a position storage controller 185. Components of the controller 160 to determine the minute open position P53 may be defined by software or by hardware. For example, the components may be implemented by a processor or may be incorporated in a circuit. Specific control of the components of the controller 160 to determine the minute open position P53 will be described later.

In this preferred embodiment, a process performed by the preprocess executor 180, the approach movement controller 181, the approach pressure determiner 182, the separation movement controller 183, the separation pressure determiner 184, and the position storage controller 185 is referred to as a "minute open position determination process." The minute open position determination process herein is a process of determining the minute open position P53. The minute open position determination process is, for example, a process performed before the printer 100 is shipped or before a user uses the printer 100 for the first time.

Next, a procedure of the minute open position determination process will be described with reference to the flowcharts of FIGS. 14A and 14B. In this preferred embodiment, since the process of determining the minute open position P53 is the same among the caps 111 through 114, the process of determining the minute open position P53 of the cap 111 will be described below.

Figure 14A:
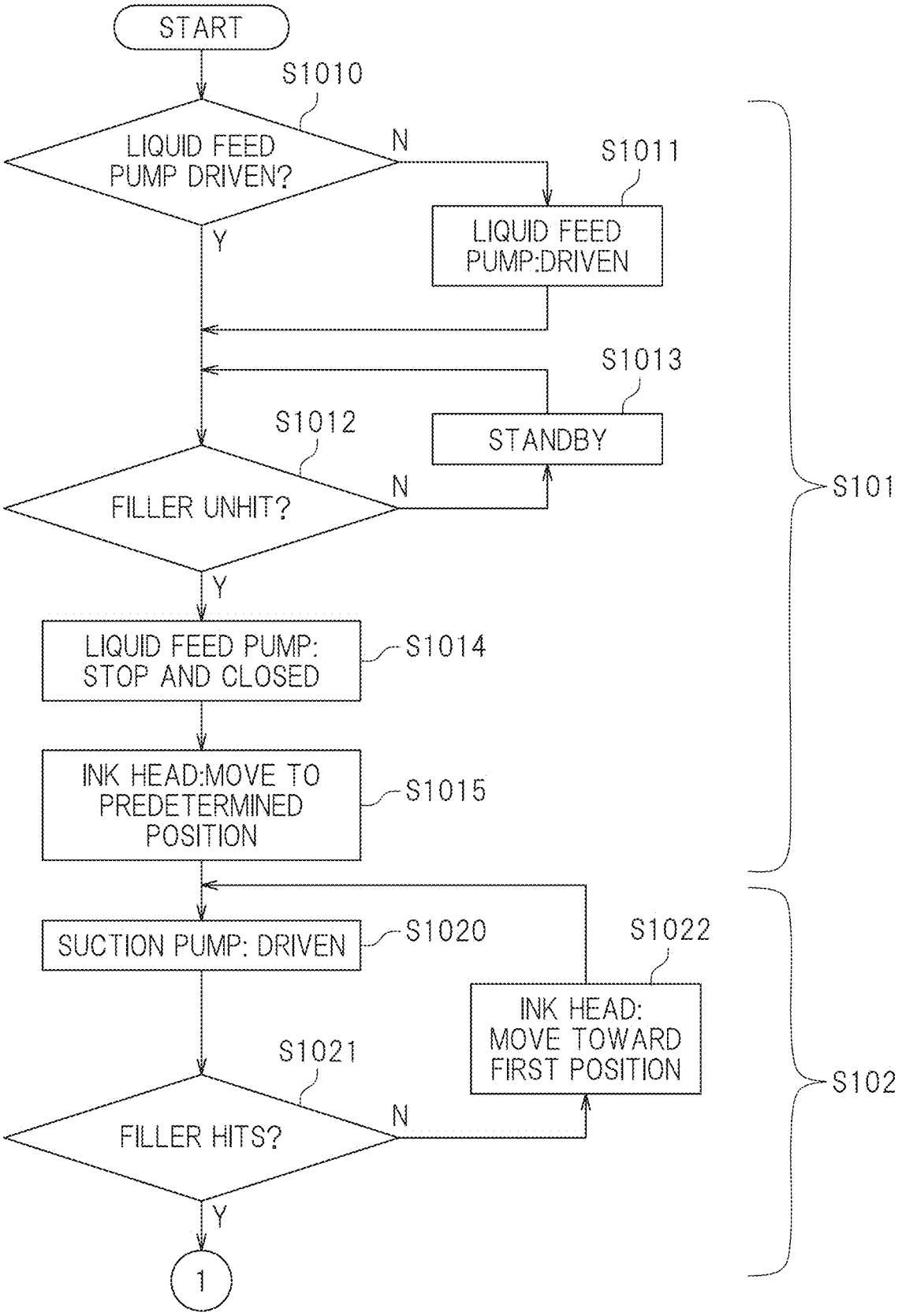
FIG. 14A is a flowchart depicting a procedure of determining a minute open position.
Figure 14B:
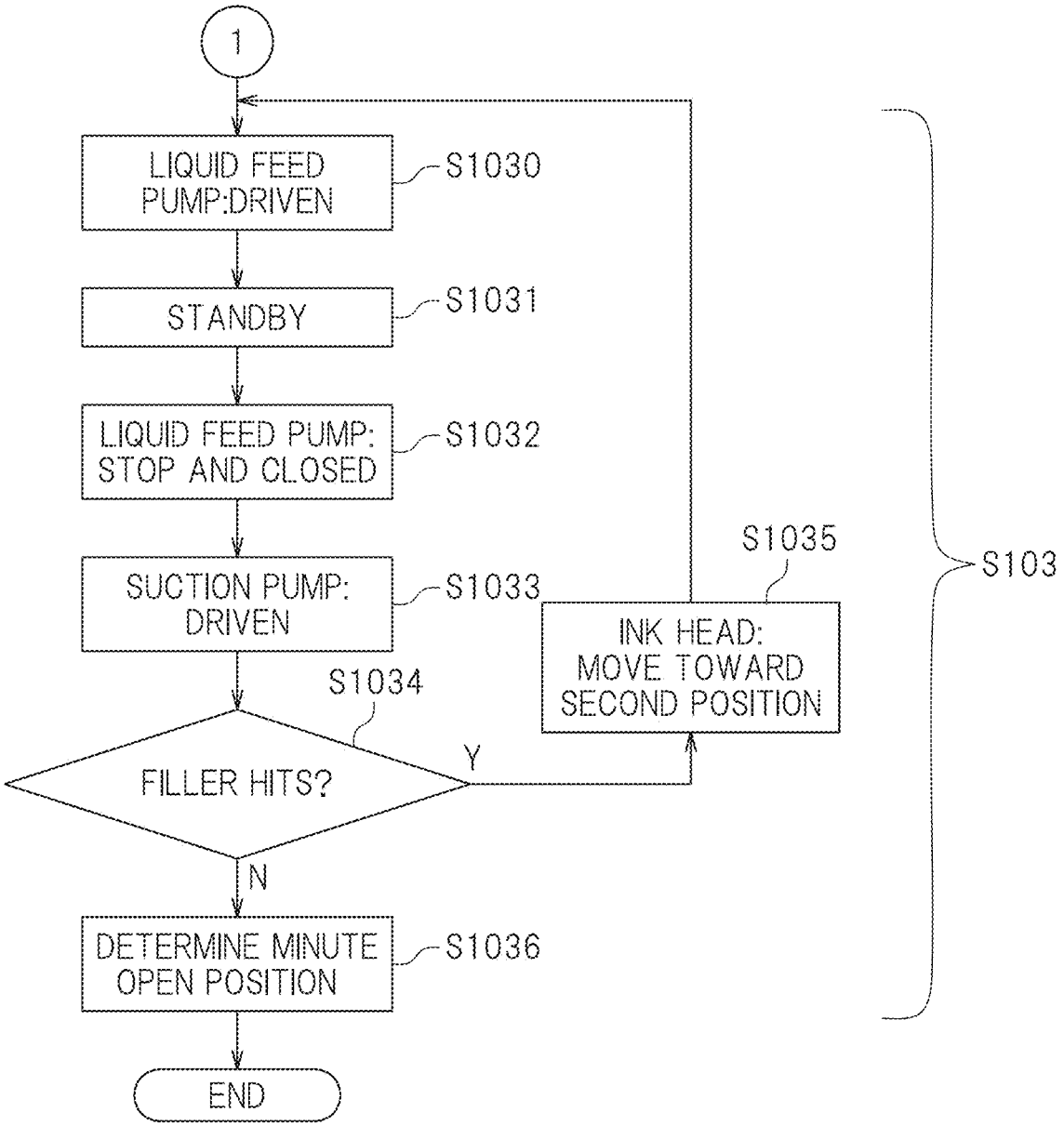
FIG. 14B is a flowchart depicting a procedure of determining a minute open position.

First, in step S101 in FIG. 14A, a preprocess is performed. In this preferred embodiment, the preprocess executor 180 is configured or programmed to perform a preprocess. The preprocess herein refers to a process performed at the previous stage of the minute open position determination process. The preprocess is a process of setting a pressure in the first ink supply path 72*a* (see FIG. 4) and a pressure in the second ink supply path 72*a* (see FIG. 4) larger than a predetermined determination pressure. To perform a preprocess, the preprocess executor 180 controls driving of the liquid feed pumps 73*a* and 73*b* (see FIG. 4). The state where the pressure is larger than the predetermined determination pressure is equivalent to a state where the fillers 87 of the dampers 74*a* and 74*b* are both unhit as illustrated in FIG. 6, that is, the fillers 87 is not located between the pair of detectors 88*a* of the filler sensor 88.

Specifically, as the preprocess, the preprocess executor 180 determines whether the liquid feed pumps 73*a* and 73*b* are driven or not (step S1010). If the liquid feed pumps 73*a* and 73*b* are not driven, the liquid feed pumps 73*a* and 73*b* are driven (step S1011). In the following description, "control of driving of the liquid feed pumps" refers to control in which if the fillers 87 hit, the liquid feed pumps are automatically controlled to be driven (i.e., rotated) and otherwise, the liquid feed pump are automatically controlled to be in a standby state (e.g., a suspended state). The state of "controlling driving of the liquid feed pumps" refers to an automatic control state. Thereafter, the preprocess executor 180 determines whether the fillers 87 are unhit or not (step S1012). In this preferred embodiment, the liquid feed pumps 73*a* and 73*b* supply ink to the ink head 41 so that as illustrated in FIG. 6, ink in the reservoirs 82 of the dampers 74*a* and 74*b* gradually increases and the damper film 83 bends outward. Accordingly, the fillers 87 comes to be unhit. That is, a pressure in the first ink supply path 72*a* and a pressure in the second ink supply path 72*b* become higher than the predetermined determination pressure.

If determination result in step S1012 is No, the preprocess executor 180 is kept on standby for a predetermined standby time (e.g., one second) (step S1013), and the determination in step S1012 is performed again. In step S1012, if the fillers 87 are determined to be unhit, the preprocess executor 180 stops driving of the liquid feed pumps 73*a* and 73*b* and closes the liquid feed pumps 73*a* and 73*b* (step S1014). In this preferred embodiment, the liquid feed pumps 73*a* and 73*b* are closed so that the ink supply paths 72*a* and 72*b* are thereby closed. Accordingly, when ink is sucked by driving of the suction pump 131 in step S1020 described later, it is possible to prevent a pressure decrease in the ink supply paths 72*a* and 72*b* caused by supply of ink from the ink tanks 71*a* and 71*b* to the ink supply paths 72*a* and 72*b*. The method for closing the ink supply paths 72*a* and 72*b* is not limited to closing of the liquid feed pumps 73*a* and 73*b*. For example, valves (not shown) disposed in the ink supply paths 72*a* and 72*b* may be closed, for example. Subsequently, the preprocess executor 180 moves the ink head 41 and the cap 111 to a predetermined position (step S1015). The predetermined position herein is a flashing position. The flashing position is a position at which flashing of discharging ink from the ink head 41 toward the cap 111, and is set between the first position P1 (see FIG. 8) and the second position P2 (see FIG. 7), for example.

As described above, after the preprocess in step S101 is finished, the minute open position determination process is performed. In this preferred embodiment, the minute open position determination process includes an approaching process (step S102) and a separating process (step S103). First, in step S102, the approaching process is executed. In this preferred embodiment, the approaching process includes an approach movement process and approach pressure determination process. The approach movement process is a process of moving the cap 111 in a direction in which the cap 111 is attached to the nozzle surface 45 in a state where the cap 111 is not attached to the nozzle surface 45 (state where the ink head 41 is at the flashing position in this preferred embodiment).

In the approach pressure determination process, while the approach movement process is performed, a first approach detection pressure that is a pressure in the first ink supply path 72*a* (see FIG. 4) is detected, and a second approach detection pressure that is a pressure in the second ink supply path 72*b* (see FIG. 4) is detected so that it is determined whether at least one of the first approach detection pressure and the second approach detection pressure is less than or equal to a predetermined determination pressure or not, that is, whether at least one of the fillers 87 of the dampers 74*a* and 74*b* hits or not. At the time when at least one of the first approach detection pressure and the second approach detection pressure becomes less than or equal to the predetermined determination pressure is the time when ink in the ink head 41 is sucked into the suction pump 131. When ink in the ink head 41 is sucked into the suction pump 131, the damper film 83 of at least one of the dampers 74*a* and 74*b* bends inward, and the amount of ink in the reservoir 82 decreases. In this preferred embodiment, the approach movement controller 181 is configured or programmed such that the approach movement process is performed. The approach pressure determiner 182 is configured or programmed to perform the approach pressure determination process.

In this preferred embodiment, an approaching process in step S102 is performed along steps S1020 through S1022. Specifically, first, the approach pressure determiner 182 drives the first suction pump 131 in a predetermined time (e.g., 10 seconds) (step S1020). Next, the approach pressure determiner 182 determines whether the filler 87 of at least one of the dampers 74*a* and 74*b* hits or not (step S1021). In step S1021, if the filler 87 of at least one of the dampers 74*a* and 74*b* hits, it is determined that at least one of the first approach detection pressure and the second approach detection pressure is less than or equal to the predetermined determination pressure. In step S1021, if the determination result is No, the approach movement controller 181 controls the head moving mechanism 30 such that the ink head 41 moves to a predetermined distance (e.g., 0.1 mm) toward the first position P1 (see FIG. 8) (step S1022). At this time, the capping mechanism 120 in conjunction with the head moving mechanism 30 causes the cap 111 to approach the nozzle surface 45 of the ink head 41. Thereafter, control in step S1020 is performed again.

On the other hand, in step S1021, if it is determined that the filler 87 of at least one of the dampers 74*a* and 74*b* hits, the process proceeds to Yes, and the approaching process in step S102 is finished. In the manner described above, the reason why the filler 87 of at least one of the dampers 74*a* and 74*b* hits because ink is sucked from at least one of the nozzles 51 and 52 so that the pressure of at least one of the ink supply paths 72*a* and 72*b* varies. The state where ink in the ink head 41 is sucked can be a state where the cap 111 is attached to the nozzle surface 45 of the ink head 41.

Subsequently, in step S103 in FIG. 14B, a separating process is performed. The separating process includes a separation movement process, a separation pressure determination process, and a position storage process. The separation movement process is a process in which if it is first determined in the approach pressure determination process that at least one of the first approach detection pressure and the second approach detection pressure is less than or equal to a predetermined determination pressure, in a state where the cap 111 is attached to the nozzle surface 45, the cap 111 is moved in the direction in which the cap 111 is separated from the nozzle surface 45.

In the separation pressure determination process, while the separation movement process is performed, a first separation detection pressure that is a pressure in the first ink supply path 72*a* (see FIG. 4) is detected, and it is determined whether the first separation detection pressure is higher than the predetermined determination pressure. In this preferred embodiment, in the separation pressure determination process, while the separation movement process is performed, the first separation detection pressure is detected, and a second separation detection pressure that is a pressure in the second ink supply path 72*b* (see FIG. 4) is detected, and it is determined whether both of the first separation detection pressure and the second separation detection pressure are higher than a predetermined determination pressure or not, that is, it is determined whether the fillers 87 of both of the dampers 74*a* and 74*b* are unhit or not. The time when both of the first separation detection pressure and the second separation detection pressure become higher than the predetermined determination pressure is a time when the state where ink in the ink head 41 is sucked into the suction pump 131 is cancelled. If ink in the ink head 41 cannot be sucked into the suction pump 131 anymore, as illustrated in FIG. 6, the outward bent of the damper film 83 of the dampers 74*a* and 74*b* is maintained.

The position storage process is a process in which a position of the cap 111 relative to the nozzle surface 45 when the first separation detection pressure is first determined to be higher than the predetermined determination pressure in the separation pressure determination process is stored in the memory 150 as the minute open position P53. In this preferred embodiment, in the position storage process, the position of the cap 111 relative to the nozzle surface 45 when the first separation detection pressure and the second separation detection pressure are first determined to be both higher than the predetermined determination pressure in the separation pressure determination process, the position of the cap 111 relative to the nozzle surface 45 is stored in the memory 150 as the minute open position P53. In this preferred embodiment, the separation movement controller 183 is configured or programmed to perform the separation movement process. The separation pressure determiner 184 is configured or programmed to perform the separation pressure determination process. The position storage controller 185 is configured or programmed to perform the position storage process.

In this preferred embodiment, the separating process in step S103 is performed along steps S1030 through S1036. Specifically, first, the separation pressure determiner 184 drives the liquid feed pumps 73*a* and 73*b* (step S1030), and is kept on standby for a predetermined time (e.g., three seconds) (step S1031). Thereafter, the separation pressure determiner 184 stops driving of the liquid feed pumps 73*a* and 73*b* and closes the liquid feed pumps 73*a* and 73*b* (step S1032). By performing these steps, the fillers 87 of the dampers 74*a* and 74*b* can be made unhit.

Then, the separation pressure determiner 184 drives the suction pump 131 for a predetermined time (e.g., 10 seconds) (step S1033). Subsequently, the separation pressure determiner 184 determines whether the fillers 87 of the dampers 74*a* and 74*b* hit or not, that is, whether fillers 87 change from the unhit state or not (step S1034). In this preferred embodiment, if the fillers 87 of the dampers 74*a* and 74*b* are unhit, it is determined that the first separation detection pressure and the second separation detection pressure are higher than the predetermined determination pressure. In step S1034, if the determination result is Yes, ink in the ink head 41 is sucked by the suction pump 131, and the amount of ink in the reservoir 82 is reduced. In this case, the separation movement controller 183 controls the head moving mechanism 30 such that the ink head 41 moves by a predetermined distance (e.g., about 0.1 mm) toward the second position P2 (see FIG. 7) (step S1035). At this time, the capping mechanism 120 in conjunction with the head moving mechanism 30 causes the cap 111 to move away from the nozzle surface 45 of the ink head 41. Thereafter, the separation pressure determiner 184 performs control in step S1030 again.

On the other hand, in step S1034, if it is determined that the fillers 87 of the dampers 74*a* and 74*b* are unhit, ink in the ink head 41 is not sucked by the suction pump 131, and the amount of ink in the reservoir 82 does not change. In this case, the process proceeds to No, and in next step S1036, the position storage controller 185 causes the memory 150 to store a position of the cap 111 relative to the nozzle surface 45 of the ink head 41 at this time. The position storage controller 185 may cause the memory 150 to store a position of the ink head 41 in the main scanning directions Y. The position of the cap 111 herein is a position at which ink in the nozzles 51 and 52 are not sucked in the cap 111 anymore. The position of the cap 111 at this time is the minute open position P53.

In this preferred embodiment, "driving" of the suction pump may include not only a state where the suction pump is always driven but also a state where the suction pump is not temporarily driven, that is, is suspended. The "driving" of the suction pump includes a state where while the caps 111 through 114 are moving away from the nozzle surfaces 45, the suction pumps are stopped in at least a portion of the time or a suction power of the suction pump is changed as appropriate, for example. In this preferred embodiment, while the caps 111 through 114 move away from the nozzle surfaces 45, the suction pumps 131 through 134 are always driven. At this time, the suction pumps 131 through 134 are driven to maintain a maximum suction power. While the suction pumps 131 through 134 are driven, the suction power of the suction pumps 131 through 134 may change.

Figure 15:
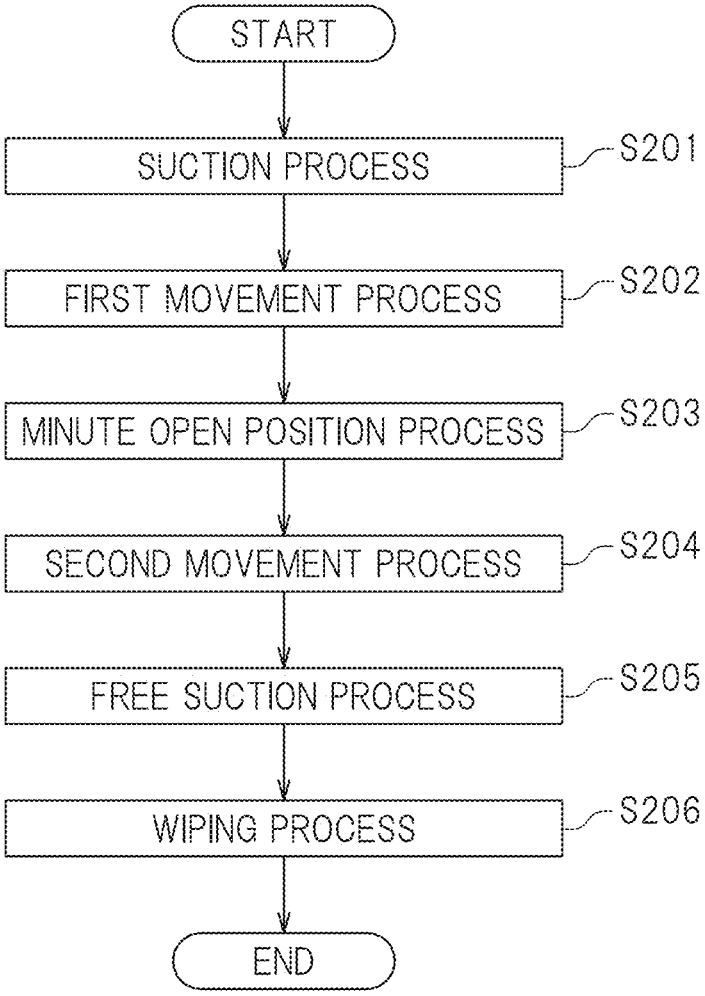
FIG. 15 is a flowchart depicting a procedure of cleaning.

The minute open position determination process has been described above. FIG. 15 is a flowchart depicting a procedure of cleaning the ink heads 41 through 44. Next, a procedure of cleaning on the ink heads 41 through 44 will be described with reference to the flowchart shown in FIG. 15. In this preferred embodiment, the procedures of cleaning the ink heads 41 through 44 are the same. Thus, the following description is directed to a cleaning procedure on the ink head 41, and description on cleaning procedures on the other ink heads 42 through 44 will be omitted as necessary.

In this preferred embodiment, as shown in FIG. 15, as cleaning on the ink heads 41 through 44, the suction process (step S201), the minute open position process (step S203), the free suction process (step S205), and the wiping process (step S206) are sequentially performed. The above processes are performed by the controller 160. In the processes in step S201 through step S205 in FIG. 15, processes are performed on the four ink heads 41 through 44 at the same time. The process in step S206 is sequentially performed on the ink heads 41 through 44. Before the suction process in step S201, as shown in FIG. 13, the memory 150 previously stores the minute open position P53 determined in accordance with the flowcharts of FIGS. 14A and 14B described above. The memory 150 stores the suction position P51 and the free suction position P52 beforehand.

First, in step S201 in FIG. 15, a suction process is performed. In this preferred embodiment, the suction controller 162 shown in FIG. 13 is configured or programmed to perform the suction process. The suction process is a process performed with the cap 111 disposed at the suction position P51 (see FIG. 11). As described above, the suction process is a process in which the cap 111 is attached to the nozzle surface 45 of the ink head 41 and ink is sucked from the nozzles 51 and 52 of the ink head 41. In other words, in the suction process, ink in the nozzles 51 and 52 of the ink head 41 is ejected to the cap 111. In this preferred embodiment, the suction controller 162 first controls the head moving mechanism 30 such that the cap 111 is located at the suction position P51 to indirectly control the capping mechanism 120. Specifically, as shown in FIG. 8, the suction controller 162 controls the head moving mechanism 30 such that the ink head 41 is moved to the first position P1. At this time, the capping mechanism 120 in conjunction with the head moving mechanism 30 gradually moves the cap 111 toward the nozzle surface 45 of the ink head 41, and at the first position P1, the cap 111 is attached to the nozzle surface 45 of the ink head 41 as illustrated in FIG. 11, and the cap 111 is located at the suction position P51.

FIG. 16 is a table showing the position of the cap 111, contacts of the end portion 118 of the cap 111 and the absorber 119 with the nozzle surface 45, a pressure in the cap 111, and driving of the suction pump 131 in each process, and also showing the amount of movement of the cap 111 per a unit time in each of first and second movement processes. As shown in FIG. 16, at the suction position P51 of the suction process, the nozzle surface 45 is in contact with the entire end portion 118 of the cap 111, and a closed space is defined between the nozzle surface 45 and the cap 111. At the suction position P51, the absorber 119 is not in contact with the nozzle surface 45.

As described above, with the cap 111 being disposed at the suction position P51, the suction controller 162 drives the suction pump 131 so that a negative pressure is generated in the cap 111. The pressure in the cap 111 is not limited to a specific level, and is, for example, about −5 kPa or less. In this preferred embodiment, control by the suction controller 162 generates a negative pressure in the cap 111, and ink in the nozzles 51 and 52 of the ink head 41 is ejected into the cap 111. The ink ejected into the cap 111 is a mixed ink in which ink in the nozzles 51 and ink in the nozzles 52 are mixed.

In this preferred embodiment, after the suction process, a so-called negative pressure adjustment process is not performed, and processes in step S202 and subsequent steps are performed. The negative pressure adjustment process herein is a process in which the suction pump 131 is stopped for a predetermined time with the cap 111 attached to the nozzle surface 45 of the ink head 41.

After the suction process, in step S202 in FIG. 15, a first movement process is performed. The first movement process is an example of a movement process of the present teaching. In this preferred embodiment, the first movement controller 163 is configured or programmed to perform the first movement process. The first movement process is a process of moving the cap 111 toward the minute open position P53. In the suction process in step S201, the cap 111 is located at the suction position P51, and thus, in the first movement process, the cap 111 is moved from the suction position P51 to the minute open position P53. The first movement controller 163 controls the head moving mechanism 30 such that the cap 111 is located at the minute open position P53 stored in the memory 150.

As illustrated in FIG. 16, while the cap 111 is moving toward the minute open position P53 in the first movement process the end portion 118 of the cap 111 is in contact with the nozzle surfaces 45, and when the cap 111 is located at the minute open position P53, a portion of the end portion 118 of the cap 111 (the uppermost end 118*a* in this preferred embodiment) is brought into contact with the nozzle surface 45, and the other portion of the end portions 118 is separated from the nozzle surface 45. While the cap 111 is moving to the minute open position P53 in the first movement process, the absorber 119 is not in contact with the nozzle surface 45.

In this preferred embodiment, while the first movement process is performed, the first movement controller 163 stops the suction pump 131. That is, while the first movement process is performed, ink in the cap 111 is not sucked by the suction pump 131. In step S201, however, since the negative pressure is generated in the cap 111, in the first movement process in step S202, a negative-pressure state is maintained in the cap 111. In the first movement process, the negative pressure is generated in the cap 111, and this negative pressure is less than or equal to a pressure in the suction process (e.g., about −5 kPa).

In addition, while the first movement process is performed, in moving the cap 111 toward the minute open position P53 by the first movement controller 163, the amount of movement of the cap 111 per a unit time is a first movement amount M1. In other words, the first movement controller 163 moves the cap 111 at a first speed. The movement amount of the cap 111 herein refers to the movement amount of a portion of the end portion 118 of the cap 111 that is first separated from the nozzle surface 45. The movement amount of the cap 111, however, is not limited to a reference portion for the movement amount. For example, the movement amount of the cap 111 may be a movement amount of a center portion of the cap 111, or a movement amount of the lowermost end of the cap 111.

After the first movement process is performed, in step S203 in FIG. 15, a minute open position process is performed. In this preferred embodiment, the minute open position controller 164 is configured or programmed to perform the minute open position process. The minute open position process is a process performed with the cap 111 located at the minute open position P53 (see FIG. 10). As illustrated in FIG. 10, the minute open position P53 is a position of the cap 111 at which a portion of the end portion 118 of the cap 111 (the uppermost end 118*a* in this preferred embodiment) is in contact with the nozzle surface 45 and the other portion of the end portion 118 is separated from the nozzle surface 45, and is a position determined according to the flowcharts of FIGS. 14A and 14B as described above. At the minute open position P53, the absorber 119 is not in contact with the nozzle surface 45. For example, mixed ink in the cap 111 can adhere to the nozzle surface 45 of the ink head 41 in some cases. The mixed ink adhering to the nozzle surfaces 45, however, connects to mixed ink in the cap 111 while the cap 111 is located at the minute open position P53.

As a specific process of the minute open position process, the minute open position controller 164 drives the suction pump 131 with the cap 111 located at the minute open position P53, as illustrated in FIG. 16. The minute open position controller 164 continues to keep the cap 111 at the minute open position P53 for a predetermined time. Thus, in the minute open position process, the suction pump 131 is continuously driven for the predetermined time. This predetermined time is stored in the memory 150 beforehand. The predetermined time is appropriately set in accordance with the amount of ink in the cap 111 that is intended to be sucked in the minute open position process. In this preferred embodiment, at the minute open position P53, a minute gap is defined between the end portion 118 of the cap 111 and the nozzle surface 45. Accordingly, the outside air is sucked through the minute gap. In the minute open position process, a negative pressure is generated in the cap 111, and the level of this negative pressure is, for example, about −5 kPa or less.

In the minute open position process, ink in the cap 111 is sucked. In this preferred embodiment, in the case where mixed ink adheres to the nozzle surface 45, mixed ink adhering to the nozzle surface 45 connects to the ink in the cap 111 as described above, and thus, the mixed ink is sucked by the suction pump 131 together with the ink in the cap 111. Thus, mixed ink is not likely to remain on the nozzle surface 45.

After the minute open position process, in step S204 in FIG. 15, a second movement process is performed. The second movement process is an example of another movement process of the present teaching. In this preferred embodiment, the second movement controller 165 is configured or programmed to perform the second movement process. The second movement process is a process of moving the cap 111 toward the free suction position P52 (see FIG. 9). In the minute open position process in step S203, since the cap 111 is located at the minute open position P53, in the second movement process, the cap 111 is moved from the minute open position P53 to the free suction position P52. The second movement controller 165 controls the head moving mechanism 30 such that the cap 111 is located at the free suction position P52 stored in the memory 150. In the second movement process, the cap 111 may move while tilted or may move without tilted.

In the second movement process, while the cap 111 moves toward the minute open position P53, the entire end portion 118 of the cap 111 is not in contact with the nozzle surface 45, and the absorber 119 is not in contact with the nozzle surface 45, either. In this preferred embodiment, during the second movement process, the second movement controller 165 stops the suction pump 131. That is, during the second movement process, ink in the cap 111 is not sucked by the suction pump 131. Thus, an atmospheric pressure is generated in the cap 111.

During the second movement process, in moving the cap 111 toward the free suction position P52 by the second movement controller 165, the amount of movement of the cap 111 per a unit time is a second movement amount M2 (see FIG. 16). In other words, the second movement controller 165 moves the cap 111 at a second speed. In this preferred embodiment, the second movement amount M2 is larger than the first movement amount M1 that is the amount of movement of the cap 111 in the first movement process in step S202. In other words, the second speed is higher than the first speed that is the speed of movement of the cap 111 in the first movement process. That is, in the second movement process, the cap 111 is moved higher than that in the first movement process.

After the second movement process, in step S205 in FIG. 15, a free suction process is performed. In this preferred embodiment, the free suction controller 166 is configured or programmed to perform the free suction process. The free suction process is performed with the cap 111 located at the free suction position P52 (see FIG. 9). In free suction position P52, the entire end portion 118 of the cap 111 is not in contact with the nozzle surface 45, and the absorber 119 is not in contact with the nozzle surface 45, either.

In free suction process, the free suction controller 166 drives the suction pump 131 as illustrated in FIG. 16 with the cap 111 located at the free suction position P52. In this preferred embodiment, at the free suction position P52, the cap 111 is separated from the nozzle surface 45. Accordingly, the outside air is sucked through a gap between the cap 111 and the nozzle surface 45. In the free suction process, a negative pressure is generated in the cap 111, and the level of this negative pressure is, for example, about −5 kPa or less. In the free suction process, ink in the cap 111 is sucked, but ink adhering to nozzle surface 45 and ink in the nozzles 51 and 52 are not sucked.

After the free suction process, in step S206 in FIG. 15, a wiping process is performed. In this preferred embodiment, the wiping controller 167 is configured or programmed to perform the wiping process. The wiping process is a process of wiping the nozzle surface 45 by the wiper 141 after the minute open position process and the free suction process. In this preferred embodiment, the wiping controller 167 controls the head moving mechanism 30 such that the ink head 41 moves above the wiping mechanism 145 (see FIG. 12). Then, when the ink head 41 passes above the wiping mechanism 145, the wiping controller 167 rotates the wiper 141 and causes the wiper 141 to wipe the nozzle surface 45 of the ink head 41. In this preferred embodiment, wiping is not performed on the ink heads 41, 42, 43, and 44 at the same time, and is sequentially performed in the order of the ink heads 41, 42, 43, and 44. Through the steps described above, cleaning on the ink heads 41 through 44 is finished.

As described above, in this preferred embodiment, as illustrated in FIG. 13, the memory 150 stores the suction position P51, the free suction position P52, and the minute open position P53. As illustrated in FIG. 11, the suction position P51 is the position of the cap 111 at which the end portion 118 of the cap 111 is in contact with the nozzle surface 45 and ink in the nozzles 51 and 52 is sucked by the suction pump 131. As illustrated in FIG. 9, the free suction position P52 is the position of the cap 111 at which the end portion 118 of the cap 111 is separated from the nozzle surface 45 and ink in the nozzles 51 and 52 is not sucked by the suction pump 131. The minute open position P53 shown in FIG. 10 is located between the suction position P51 and the free suction position P52. The controller 160 performs the suction process of sucking ink from the nozzles 51 and 52 (step S201 in FIG. 15) with the cap 111 located at the suction position P51, the first movement process of moving the cap 111 toward the minute open position P53 (step S202 in FIG. 15) after the suction process, and the minute open position process of stopping movement of the cap 111 (step S203 in FIG. 15) with the cap 111 located at the minute open position P53 after the first movement process.

In this preferred embodiment, after the suction process (step S201 in FIG. 15), a so-called negative pressure adjustment process is not performed, and the minute open position process (step S203 in FIG. 15) is performed. In the suction process, when the suction pump 131 is driven, a negative pressure is thereby generated in the cap 111. With the negative pressure being generated in the cap 111, the cap 111 moves to the minute open position P53 in the first movement process (step S202 in FIG. 15), and the minute open position process is performed. Immediately after the minute open position process, the inside of the cap 111 is under the negative pressure, and thus, ink in the cap 111 is sucked. As described above, in the printer 100 according to this preferred embodiment, a so-called negative pressure adjustment process is not performed, and the minute open position process in which ink in the cap 111 is sucked is performed. Accordingly, the time necessary for the negative pressure adjustment process can be reduced so that a time having a possibility of entering of ink in the cap 111 into the nozzles 51 and 52. As a result, ink in the cap 111 does not easily enter the nozzles 51 and 52.

In this preferred embodiment, the minute open position P53 at which the cap 111 is located in the minute open position process is a position at which the end portion 118 of the cap 111 is closer to the nozzle surface 45 than at the free suction position P52. Accordingly, the gap between the surface 45 and the cap 111 is relatively small so that ink in the cap 111 is not likely to spatter.

In this preferred embodiment, as illustrated in FIGS. 9 and 10, the distance from the uppermost end 118*a* of the cap 111 to the nozzle surface 45 in the free suction position P52 is a first distance D1. The distance from the uppermost end 118*a* of the cap 111 to the nozzle surface 45 in the minute open position P53 is a second distance D2 less than or equal to about 1/10 of the first distance D1. Accordingly, at the minute open position P53, the end portion 118 of the cap 111 is closer to the nozzle surface 45 than at the free suction position P52. Thus, at the minute open position P53, the gap between the nozzle surface 45 and the end portion 118 of the cap 111 can be further reduced. As a result, during the minute open position process, ink in the cap 111 is less likely to enter the nozzles 51 and 52.

In this preferred embodiment, the controller 160 stops the suction pump 131 as illustrated in FIG. 16 during the first movement process of moving the cap 111 from the suction position P51 to the minute open position P53. For example, in the suction process and the minute open position process, a process in which the dampers 74*a* and 74*b* (see FIG. 4) detects the ink amount in the ink supply paths 72*a* and 72*b* (see FIG. 4) is performed. If the suction pump 131 is driven during the first movement process, the ink amount detected in the suction process and the ink amount detected in the minute open position process vary in some cases. However, in this preferred embodiment, since the suction pump 131 is stopped during the first movement process, occurrence of these variations is able to be reduced or eliminated.

In this preferred embodiment, as illustrated in FIG. 10, the minute open position P53 is a position of the cap 111 when a portion of the end portion 118 of the cap 111 (the uppermost end 118*a* in this preferred embodiment) is in contact with the nozzle surfaces 45 and the other portion of the end portion 118 (upper end except for the uppermost end 118*a*) is separated from the nozzle surface 45. Accordingly, in moving the cap 111 at the suction position P51 (see FIG. 11) toward the minute open position P53, as illustrated in FIG. 10, the entire upper end of the end portion 118 of the cap 111 is not separated from the nozzle surface 45 at the same time, and the end portion 118 is gradually separated from the nozzle surface 45. In the example of FIG. 10, the end portion 118 is gradually separated from the nozzle surface 45 from the left portion of the end portion 118. Thus, in separating the cap 111 attached to the nozzle surface 45 from the nozzle surface 45, ink adhering to the end portion 118 of the cap 111 does not easily spatter.

In this preferred embodiment, as illustrated in FIG. 9, the capping mechanism 120 (see FIG. 7) of the cap assembly 110 (see FIG. 7) moves the cap 111 relative to the nozzle surface 45 while the cap 111 is tilted. Accordingly, the upper end surface of the cap 111 can be tilted by a simple method of tilting the cap 111 itself.

In this preferred embodiment, during the minute open position process, the controller 160 drives the suction pump 131 as illustrated in FIG. 16. Accordingly, in the minute open position process, ink in the cap 111 can be actively sucked by the suction pump 131.

In this preferred embodiment, during the minute open position process, the controller 160 keeps the cap 111 at the minute open position P53 for the predetermined time. At the minute open position P53, a minute gap is defined between the cap 111 and the nozzle surface 45, and the air is taken in the cap 111 through the minute gap. Thus, the state where the cap 111 is at the minute open position P53 is kept for the predetermined time so that the negative pressure in the cap 111 is easily canceled.

In this preferred embodiment, the controller 160 performs the second movement process of moving the cap 111 toward the free suction position P52 (step S204 in FIG. 15) after the minute open position process, and the free suction process of driving the suction pump 131 with the cap 111 located at the free suction position P52 after the second movement process. As shown in FIG. 16, the amount of movement of the cap 111 per a unit time in the first movement process (step S202 in FIG. 15) is the first movement amount M1. The amount of movement of the cap 111 per a unit time in the second movement process is the second movement amount M2 larger than the first movement amount M1. Accordingly, the movement speed of the cap 111 in the first movement process is lower than that of the cap 111 in the second movement process. Thus, in the first movement process, ink in the cap 111 does not easily leak from an upper portion.

In this preferred embodiment, at the minute open position P53, the absorber 119 is separated from the nozzle surface 45. If the absorber 119 is in contact with the nozzle surface 45, the nozzle surface 45 is scratched by the absorber 119, resulting in the possibility of a discharge failure of the nozzles 51 and 52. In this preferred embodiment, however, since the absorber 119 is not in contact with the nozzle surface 45, it is possible to reduce or eliminate scratching of the nozzle surface 45 by the absorber 119.

In this preferred embodiment, in the nozzles 51 and 52 in the nozzle surface 45 of the ink head 41, ink discharged from the nozzles 51 is different from ink discharged from the nozzles 52. As least after the minute open position process, the controller 160 separates the cap 111 from the nozzle surface 45 and performs the wiping process of wiping the nozzle surface 45 with the wiper 141. In this preferred embodiment, in the suction process, the cap 111 stores mixed ink as a mixture of two different types of inks sucked from the nozzles 51 and 52. In the minute open position process, mixed ink in the cap 111 is sucked with the cap 111 moved to the minute open position P53. In the minute open position process, even in a case where mixed ink adheres to the nozzle surface 45, for example, the mixed ink adhering to the nozzle surface 45 is easily sucked together with the mixed ink in the cap 111. Thus, in wiping the nozzle surface 45 in the wiping process, mixed ink does not easily enter the nozzles 51 and 52 of the ink head 41.

In this preferred embodiment, the controller 160 performs the minute open position determination process of determining the minute open position P53. The minute open position determination process includes the separation movement process, the separation pressure determination process, and the position storage process. For example, the suction pump 131 is driven with the cap 111 attached to the nozzle surface 45 of the ink head 41 so that ink in the ink head 41 is sucked and discharged into the cap 111. At this time, the pressures in the ink supply paths 72*a* and 72*b* for the ink head 41 decrease because of the discharge of ink, and reach a predetermined detection pressure or less. On the other hand, a case where the pressures in the ink supply paths 72*a* and 72*b* are higher than the predetermined detection pressure means a state where ink in the ink head 41 is not sucked. As described above, the position of the cap 111 relative to the nozzle surface 45 shifted from a case where ink in the ink head 41 is ejected by the suction pump 131 to a case where ink in the ink head 41 is not ejected by the suction pump 131 is a position at which ink in the cap 111 is sucked and ink in the nozzles 51 and 52 is not sucked, and a position at which the cap 111 is closest to the nozzle surface 45. In this preferred embodiment, by detecting the pressures in the ink supply paths 72*a* and 72*b*, it is possible to set a position at which ink in the cap 111 can be sucked with ink in the nozzles 51 and 52 not sucked, and the cap 111 is closest to the nozzle surface 45. This position is set as the minute open position P53, and the minute open position process is performed at the minute open position P53. Accordingly, entering of mixed ink into the ink head 41 is able to be reduced or prevented. In addition, since the cap 111 is relatively close to the nozzle surface 45, leakage of ink in the cap 111 to the outside is able to be reduced or prevented. As a result, the minute open position process can be appropriately performed.

In this preferred embodiment, before the separating process including the separation movement process and the separation pressure determination process (step S103 in FIG. 14B), the approaching process including the approach movement process and the approach pressure determination process (step S102 in FIG. 14A) is performed. In this approaching process, a timing when the state where ink in the ink head 41 is not sucked by the suction pump 131 is shifted to the state where ink in the ink head 41 is sucked by the suction pump 131 is determined. On the other hand, in the separating process, a timing when the state where ink in the ink head 41 is sucked by the suction pump 131 is shifted to the ink in the ink head 41 not is sucked by the suction pump 131 is determined. Ink sucked by the suction pump 131 is discarded, and is waste ink. Thus, as the duration of the separating process increases, the amount of discarded ink increases, which causes a waste of ink. In this preferred embodiment, however, the approaching process is performed before the separating process so that a position at which ink in the ink head 41 is not sucked by the suction pump 131 can be roughly specified. Thus, by performing the separating process after the approaching process, the duration of the separating process can be relatively shortened, and the amount of ink sucked by the suction pump 131 can be reduced. Accordingly, the amount of ink discarded by performing control to determine the minute open position P53 can be reduced.

The dampers 74*a* and 74*b* illustrated in FIG. 5 is used to control the timing of supplying ink in printing. In this preferred embodiment, the filler sensors 88 of the dampers 74*a* and 74*b* are used to detect the pressures of the ink supply paths 72*a* and 72*b* so that the minute open position P53 is determined. Thus, no dedicated pressure sensors to determine the minute open position P53 need to be provided in the ink supply paths 72*a* and 72*b*, and thus, the number of parts can be reduced, and manufacturing costs can be reduced.

The present preferred embodiment includes a computer program that causes a computer to execute the suction process, the first movement process, the minute open position process, the second movement process, the free suction process, and the wiping process performed by the controller 160, and a non-transitory recording medium storing the computer program. This preferred embodiment also includes a computer program to determine a minute open position to cause a computer to perform the minute open position determination process (specifically, the approach movement process, the approach pressure determination process, the separation movement process, the separation pressure determination process, and the position storage process) performed by the controller 160, and a non-transitory recording medium storing a computer program to determine a minute open position.

The ink jet printer 100 according to this preferred embodiment has been described. In the preferred embodiments described above, the suction pumps 131 through 134 are stopped in the first movement process in step S202 and the second movement process in step S204. Alternatively, in the first movement process, the first movement controller 163 may drive the suction pumps 131 through 134. In the second movement process, the second movement controller 165 may drive the suction pumps 131 through 134.

In the preferred embodiments described above, the suction pumps 131 through 134 are driven in the minute open position process in step S203. Alternatively, in the minute open position process, the suction pumps 131 through 134 may be stopped. Even in this case, the negative-pressure state in the cap 111 in the suction process and the first movement process is also kept in the minute open position process, and thus, ink in the cap 111 can be sucked. Thus, a so-called negative pressure adjustment process can be omitted so that a time having a possibility of entering of ink in the cap 111 into the nozzles 51 and 52 can be reduced. As a result, ink in the cap 111 does not easily enter the nozzles 51 and 52. In the minute open position process, to stop the suction pumps 131 through 134, the negative pressure in the cap 111 is preferably low (e.g., about a pressure in a normal suction process, e.g., about −50 kPa or less) or the free suction process in step S205 is preferably not omitted and is performed.

In the preferred embodiments described above, in the free suction process in step S205, the suction pumps 131 through 134 are driven. Alternatively, in the minute open position process in step S203, in a case where most of ink in the cap 111 (e.g., 90% or more of ink in the cap 111) is sucked, the free suction controller 166 preferably stops the suction pumps 131 through 134. In the minute open position process in step S203, in the case where most of the ink in the cap 111 is sucked, the second movement process in step S204 and the free suction process in step S205 may be omitted. In this case, the minute open position process includes a free suction process.

Figure 17:
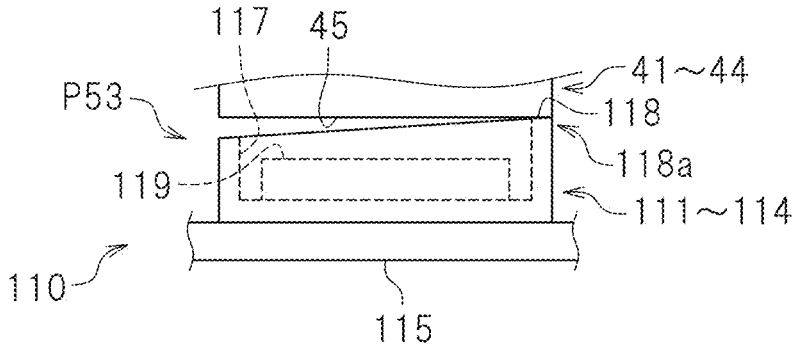
FIG. 17 is a front view illustrating a cap of another preferred embodiment of the present invention, and corresponds to FIG. 10.

In the preferred embodiments described above, by tilting the cap 111 itself, the cap 111 moves between the suction position P51 and the minute open position P53 and between the minute open position P53 and the free suction position P52, with the end portion 118 of the cap 111 tilted. Alternatively, as described in another preferred embodiment shown in FIG. 17, the cap 111 may be movable without a tilt. In this case, the upper end surface of the end portion 118 of the cap 111 may be tilted. The expression "the upper end surface of the end portion 118 is tilted" means that the upper end surface of the end portion 118 tilts relative to the bottom surface of the cap 111. This configuration enables the upper end surface of the end portion 118 tilts relative to the nozzle surface 45 without a tilt of the cap 111 itself.

In the preferred embodiments described above, at the minute open position P53, a portion of the end portion 118 of the cap 111 (the uppermost end 118*a* in this preferred embodiment) is in contact with the nozzle surface 45 and the other portion of the end portion 118 is separated from the nozzle surface 45. Alternatively, at the minute open position P53, the uppermost end 118*a* of the end portion 118 of the cap 111 may not be in contact with the nozzle surface 45, and a slight gap may be defined between the uppermost end 118*a* and the nozzle surface 45.

In the preferred embodiments described above, one ink head discharges different types of inks. One ink head is connected to two ink supply systems. Alternatively, one ink head may discharge the same type of ink. One ink head may be connected to one ink supply system.

In the preferred embodiments described above, the capping mechanism 120 lifts and lowers the caps 111 through 114 in conjunction with the head moving mechanism 30. Alternatively, the capping mechanism according to a preferred embodiment of the present disclosure may include a driving motor to lift and lower the caps 111 through 114 by driving this driving motor. The capping mechanism according to a preferred embodiment of the present disclosure may be configured such that the caps 111 through 114 are lifted and lowered at the first position P1 after the ink heads 41 through 44 have reached the first position P1.

In the preferred embodiments described above, after the approaching process (step S102 in FIG. 14A), the separating process (step S103 in FIG. 14B) is performed. Alternatively, the approaching process may be omitted. In this case, the separating process preferably at a position at which the caps 111 through 114 are attached to the nozzle surfaces 45 (e.g., the first position P1).

In the preferred embodiments described above, in the approach pressure determination process (control of the approach pressure determiner 182 in the preferred embodiment), it is determined whether at least one of the first approach detection pressure and the second approach detection pressure is less than or equal to the determination pressure or not. In the separation movement process (control of the separation movement controller 183 in this preferred embodiment), if at least one of the first approach detection pressure and the second approach detection pressure is less than or equal to the determination pressure, the caps 111 through 114 are moved in the direction in which the caps 111 through 114 are separated from the nozzle surfaces 45. Alternatively, the approach pressure determiner 182 may determine whether both of the first approach detection pressure and the second approach detection pressure are less than or equal to the determination pressure or not. In this case, if the approach pressure determiner 182 determines that both the first approach detection pressure and the second approach detection pressure are less than or equal to the determination pressure, the separation movement controller 183 moves the caps 111 through 114 in the direction in which the caps 111 through 114 are separated from the nozzle surfaces 45.

In the preferred embodiments described above, the first pressure detection mechanism and the second pressure detection mechanism according to a preferred embodiment of the present disclosure are the filler sensors 88 of the dampers 74*a* and 74*b*. Alternatively, the first pressure detection mechanism and the second pressure detection mechanism may be so-called pressure sensors disposed in the ink supply paths 72*a* and 72*b*.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An ink jet printer comprising:

an ink head including a nozzle surface including first nozzles that discharge ink;

a cap assembly including a cap, a suction device, and a capping mechanism, the cap being attachable to the nozzle surface to cover the first nozzles and including an end portion that is contactable with the nozzle surface when attached to the nozzle surface, the suction device being connected to the cap, the capping mechanism being configured to attach the cap to the nozzle surface and separate the cap from the nozzle surface;

a memory that stores a suction position, a free suction position, and a minute open position beforehand, the suction position being a position of the cap at which the end portion of the cap is in contact with the nozzle surface and ink in the first nozzles is sucked by the suction device, the free suction position being a position of the cap at which the end portion of the cap is separated from the nozzle surface and ink in the first nozzles is not sucked by the suction device, the minute open position located between the suction position and the free suction position; and a controller; wherein the minute open position is a position of the cap at which the cap is closest to the nozzle surface among positions of the cap at which ink cannot be sucked from the nozzle of the ink head by the suction device;

the controller is configured or programmed to perform:

a suction process in which ink is sucked from the first nozzles with the cap located at the suction position;

a movement process in which the cap is moved toward the minute open position after the suction process;

a minute open position process in which movement of the cap is stopped with the cap located at the minute open position after the movement process;

another movement process in which the cap is moved toward the free suction position after the minute open position process; and a free suction process in which the suction device is driven with the cap located at the free suction position after the another movement process;

an amount of movement of the cap per a unit time in the movement process is a first movement amount; and an amount of movement of the cap per a unit time in the another movement process is a second movement amount larger than the first movement amount.

2. The ink jet printer according to claim 1, wherein the cap assembly includes an absorber disposed in the cap; and at the minute open position, the absorber is separated from the nozzle surface.

3. The ink jet printer according to claim 1, further comprising:

a wiper; and a wiping mechanism that supports the wiper and causes the wiper to contact the nozzle surface and to be separated from the nozzle surface; wherein the controller is configured or programmed to perform a wiping process in which the nozzle surface is wiped by the wiper at least after the minute open position process.

4. The ink jet printer according to claim 1, wherein the nozzle surface of the ink head includes second nozzles that discharge another ink different from the ink; and the cap is attachable to the nozzle surface to cover the first nozzles and the second nozzles.

5. A non-transitory recording medium storing a computer program to perform cleaning in the ink jet printer according to claim 1, the computer program causing at least a computer to execute the suction process, the movement process, and the minute open position process.

6. An ink jet printer comprising:

an ink head including a nozzle surface including first nozzles that discharge ink;

an ink tank that stores ink;

an ink supply path that allows the ink tank and the first nozzles to communicate with each other; and a pressure detector that detects a pressure in the ink supply path;

a cap assembly including a cap, a suction device, and a capping mechanism, the cap being attachable to the nozzle surface to cover the first nozzles and including an end portion that is contactable with the nozzle surface when attached to the nozzle surface, the suction device being connected to the cap, the capping mechanism being configured to attach the cap to the nozzle surface and separate the cap from the nozzle surface;

a memory that stores a suction position, a free suction position, and a minute open position beforehand, the suction position being a position of the cap at which the end portion of the cap is in contact with the nozzle surface and ink in the first nozzles is sucked by the suction device, the free suction position being a position of the cap at which the end portion of the cap is separated from the nozzle surface and ink in the first nozzles is not sucked by the suction device, the minute open position located between the suction position and the free suction position; and a controller; wherein the controller is configured or programmed to perform:

a suction process in which ink is sucked from the first nozzles with the cap located at the suction position;

a movement process in which the cap is moved toward the minute open position after the suction process;

a minute open position process in which movement of the cap is stopped with the cap located at the minute open position after the movement process; and a minute open position determination process to determine the minute open position;

the minute open position determination process includes:

an approach movement process in which the cap is moved in a direction in which the cap is attached to the nozzle surface; and an approach pressure determination process in which an approach detection pressure that is a pressure in the ink supply path is detected and it is determined whether the approach detection pressure is less than or equal to the predetermined determination pressure or not, during the approach movement process;

a separation movement process in which the cap is moved in a direction in which the cap is separated from the nozzle surface;

a separation pressure determination process in which a separation detection pressure that is a pressure in the ink supply path is detected and it is determined whether the separation detection pressure is larger than a predetermined determination pressure or not, during the separation movement process; and a position storage process in which a position of the cap relative to the nozzle surface when the separation detection pressure is first determined to be larger than the predetermined determination pressure in the separation pressure determination process is stored in the memory as the minute open position; and in the separation movement process, when it is first determined that the approach detection pressure is less than or equal to the determination pressure in the approach pressure determination process, the cap is moved in the direction in which the cap is separated from the nozzle surface.

7. The ink jet printer according to claim 6, further comprising:

a damper disposed in the ink supply path; wherein the damper includes:

a reservoir locally including an opening, the reservoir communicating with the ink supply path; and a damper film covering the opening of the reservoir; and the pressure detector detects a pressure in the reservoir.

8. The ink jet printer according to claim 7, wherein the damper includes:

a pressing body provided on the damper film; and a filler disposed at an opposite side to the reservoir with respect to the damper film, a position of the filler being changed in accordance with movement of the pressing body;

the pressure detector includes a filler sensor that detects whether the filler moves into a predetermined range or not, and if the filler is not located in the predetermined range, detects that a pressure in the reservoir is higher than the predetermined determination pressure;

in the separation pressure determination process, it is determined whether the filler is located in the predetermined range or not by using the filler sensor; and in the position storage process, a position of the cap relative to the nozzle surface at which it is first determined that the filler is not located in the predetermined range in the separation pressure determination process is stored, as the minute open position, in the memory.

* * * * *